US012146253B2

(12) United States Patent
Yeom

(10) Patent No.: US 12,146,253 B2
(45) Date of Patent: Nov. 19, 2024

(54) LAUNDRY TREATING APPARATUS

(71) Applicant: LG Electronics Inc., Seoul (KR)

(72) Inventor: Hanbeom Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 556 days.

(21) Appl. No.: 17/406,661

(22) Filed: Aug. 19, 2021

(65) Prior Publication Data

US 2022/0064837 A1 Mar. 3, 2022

(30) Foreign Application Priority Data

Aug. 26, 2020 (KR) ..... 10-2020-0107914

(51) Int. Cl.

| | |
|---|---|
| ***D06F 33/36*** | (2020.01) |
| ***D06F 23/04*** | (2006.01) |
| ***D06F 37/30*** | (2020.01) |
| ***D06F 39/08*** | (2006.01) |
| *D06F 103/18* | (2020.01) |
| *D06F 105/02* | (2020.01) |
| *D06F 105/46* | (2020.01) |
| *D06F 105/62* | (2020.01) |

(52) U.S. Cl.

CPC ..... *D06F 33/36* (2020.02); *D06F 23/04* (2013.01); *D06F 37/30* (2013.01); *D06F 39/087* (2013.01); *D06F 2103/18* (2020.02); *D06F 2105/02* (2020.02); *D06F 2105/46* (2020.02); *D06F 2105/62* (2020.02)

(58) Field of Classification Search

CPC ..... D06F 33/36

See application file for complete search history.

(56) References Cited

U.S. PATENT DOCUMENTS

2016/0115635 A1* 4/2016 Lee ..... D06F 39/083 68/132

* cited by examiner

*Primary Examiner* — Jason Y Ko

(74) *Attorney, Agent, or Firm* — Fish & Richardson P.C.

(57) ABSTRACT

A laundry treating apparatus include a tub, a water supply, a drum, and a rotator including a bottom portion positioned on a bottom surface of the drum, and a pillar protruding upward from the bottom portion, and a blade disposed on an outer circumferential surface of the pillar. The controller controls a driver such that the rotator performs a distribution motion after a water supply process and a washing motion after the distribution motion. An amount of rotation of the rotator in the distribution motion is less than an amount of rotation of the rotator in the washing motion. A driving load of the driver is reduced by reducing a moment of inertia acting on the rotator by separating laundry from the rotator. With the reduced driving load, the driver may be easily controlled, and a water flow for washing may be efficiently formed.

7 Claims, 13 Drawing Sheets

LAUNDRY TREATING APPARATUS

CROSS-REFERENCE TO RELATED APPLICATIONS

This application claims the benefit of Korean Patent Application No. 10-2020-0107914, filed on Aug. 26, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

In one example, when the laundry is put into the laundry treating apparatus, the rotator and the laundry may be tangled in response to the rotation of the rotator during a washing process. As the rotator rotates, the drum may also be rotated by the tangled laundry. That is, a large moment of inertia may act on the rotator, causing an operation failure. In addition, it may be difficult to control the driver during the washing process. Accordingly, it is an important task in the present technical field to prevent the operation failure through efficient rotation of the rotator and to facilitate the control of the driver.

Furthermore, it is an important task in the present technical field to improve a washing effect of the clothes by establishing an appropriate rotation strategy of the rotator in consideration of the water flow forming effect of the rotator.

SUMMARY

Embodiments of the present disclosure are intended to provide a laundry treating apparatus that may reduce a moment of inertia acting on a rotator when the rotator rotates and a driving load of a driver by defining a space between laundry and the rotator in an initial operation of a washing process in which a large amount of laundry is washed.

In addition, embodiments of the present disclosure are intended to provide a laundry treating apparatus in which a driver that rotates a rotator may be easily controlled by defining a space between laundry and the rotator in a washing process.

In addition, embodiments of the present disclosure are intended to provide a laundry treating apparatus in which a driver is easily controlled, so that a rotator that forms a water flow may be efficiently utilized and a washing efficiency may be increased.

In addition, embodiments of the present disclosure are intended to provide a method for controlling a laundry treating apparatus including a distribution motion before a washing motion such that various washing motions of a rotator may be effectively utilized in a washing process of clothes.

When there is a rotator that forms a water flow inside a drum of a laundry treating apparatus, the rotator may be decelerated by adjusting an amount of rotation of the rotator by a driver in a left and right direction during agitation in the left and right direction, for example, a rotation angle or adjusting a gear ratio.

However, in one embodiment of the present disclosure, the rotator disposed in the drum may include an inclined blade, and various washing motions of the rotator may be implemented by placing a deviation in amounts of rotation of rotation in one direction and rotation in the other direction using water flow characteristics based on an inclination of the blade.

That is, one embodiment of the present disclosure may be a laundry treating apparatus in a form of a top loader, and the rotator may perform three-dimensional washing in which a water flow ascends and descends through the inclined blade.

The laundry treating apparatus in the form of the top loader may cause friction in laundry or the water flow may pass through the laundry, so that washing of the laundry of clothes may be performed. A top loader scheme may be distinguished as flat washing, and there is room for damage to the laundry during the washing, but a washing time may be short and a washing cost may be high.

However, because a pillar and the blade are disposed, a driving load of the driver may be increased. In particular, when a large amount of laundry is washed, the laundry may get tangled with the pillar and the blade during a washing process and the drum may rotate together when the rotator rotates. That is, a large moment of inertia may act on the rotator when the rotator rotates, and the driving load of the driver that rotates the rotator may increase.

One embodiment of the present disclosure may reduce the moment of inertia acting on the rotator by performing a distribution motion before a washing motion to define a space between the blade and the laundry. In addition, the driving load of the driver that rotates the rotator may be reduced, preventing the driver from an operation failure, and enabling easy control of the driver during the washing process.

In addition, one embodiment of the present disclosure may improve the advantages and ameliorate the disadvantages of the flat washing by establishing a motion strategy of the rotator having the blade in the inclined shape.

In one embodiment of the present disclosure, as the washing motions of the rotator, a common rotation scheme and a motion in consideration of ascending and descending of the water flow may be presented. In the common motion, the rotator may perform repeated rotation in which an amount of rotation of the driver, that is, a rotation angle of the rotator is constant in one direction and the other direction.

In one example, in one embodiment of the present disclosure, the washing motion may include an ascending and descending motion. The ascending and descending motion may include an ascending motion and a descending motion. An ascending is a washing motion that allows an ascending water flow to be formed, and a descending motion is a washing motion that allows a descending water flow to be formed.

In the ascending motion, the rotator may perform the rotation in the other direction after the rotation in one direction. The rotation in one direction may have a larger rotation angle than the rotation in the other direction. In the descending motion, the rotator may perform the rotation in one direction after the rotation in the other direction, and the rotation in the other direction may have a larger rotation angle than the rotation in one direction.

One embodiment of the present disclosure may perform an optimal washing course based on a material, a moisture content, and a load amount of the laundry in the washing process through the various washing motions as above. One embodiment of the present disclosure may perform the three-dimensional water flow formation and the washing motion that are not able to be implemented with a rotator including a blade extending in a vertical direction.

Such laundry treating apparatus according to an embodiment of the present disclosure may include a tub having therein a space for water to be stored, a water supply constructed to provide water to be supplied to the tub, a drum disposed inside the tub, and having an open top surface for inserting clothes therethrough, a rotator rotatably installed on a bottom surface of the drum, a driver constructed to provide a rotational force to the rotator, and a controller that controls the driver.

The rotator may include a bottom portion positioned on the bottom surface of the drum, and a pillar protruding upward from the bottom portion and having a blade disposed on an outer circumferential surface thereof. A washing process of the clothes may include a water supply process for supplying water into the tub through the water supply at least once, The controller may control the driver such that the rotator performs a distribution motion for defining a space between the clothes and the blade after termination of the water supply process, and the rotator performs a washing motion for forming a water flow after the distribution motion control. The controller may control the driver such that an amount of rotation of the rotator in the distribution motion is less than an amount of rotation of the rotator in the washing motion.

In addition, the controller may control the driver such that a rotation speed of the rotator in the distribution motion is lower than a rotation speed of the rotator in the washing motion.

In addition, the tub may include a water level sensor capable of measuring a water level of the tub, the controller may determine the water level of the tub through the water level sensor, and the controller may control the driver such that the rotator performs the distribution motion only when the water level of the tub is equal to or higher than a distribution reference water level.

In addition, the laundry treating apparatus may further include a detergent feeder constructed to supply detergent to be provided to the tub, the washing process may include a cleaning process for supplying the detergent to the tub from the detergent feeder and removing foreign substances from the clothes, the cleaning process may include the water supply process at least once, and the controller may control the driver such that the rotator performs the distribution motion within a cleaning distribution reference time after the cleaning process starts.

In addition, the distribution motion may include a first distribution motion for rotating the rotator in one direction, and a second distribution motion for rotating the rotator in the other direction, and the controller may control the driver such that a first amount of distribution rotation of the rotator in the first distribution motion is the same as a second amount of distribution rotation of the rotator in the second distribution motion.

In addition, the distribution motion may include a stop motion for stopping the rotator, and the controller may perform the stop motion after the first distribution motion, and perform the second distribution motion after the stop motion.

In addition, the blade may extend obliquely with respect to a longitudinal direction of the pillar to form an ascending water flow when the rotator rotates in said one direction and form a descending water flow when the rotator rotates in the other direction.

In addition, the washing motion may include an ascending and descending motion for rotating the rotator to form the ascending water flow or the descending water flow, and the controller may control the driver such that the rotation in said one direction and the rotation in the other direction of the rotator are performed with different amounts of rotation in the ascending and descending motion.

In addition, the ascending and descending motion may include an ascending motion for forming the ascending water flow, and the controller may control the driver such that the rotator is rotated in said one direction by a first amount of rotation in the ascending motion, and rotated in the other direction by a second amount of rotation less than the first amount of rotation.

In addition, the controller may control the driver such that the first amount of distribution rotation is less than 0.25 times the first amount of rotation.

In addition, the ascending and descending motion may include a descending motion for forming the descending water flow, and the controller may control the driver such that the rotator rotates by a third amount of distribution rotation in the other direction and rotates by a fourth amount of rotation less than the third amount of distribution rotation in said one direction in the descending motion.

In addition, the controller may control the driver such that the rotator performs the distribution motion within a water supply distribution reference time after the termination of the water supply process, and the rotator performs the washing motion within a water supply washing reference time after the distribution motion.

In one example, a method for controlling a laundry treating apparatus according to an embodiment of the present disclosure may include a washing operation for performing at least one of a cleaning operation for removing foreign substances from clothes inserted into a drum, a rinsing operation for discharging the foreign substances from a tub after the cleaning operation, and a dehydration operation for removing moisture from the clothes after the rinsing operation.

The washing operation may include a water supply operation for supplying water into the tub through the water supply at least once, the controller may control the driver such that the rotator performs a distribution motion for defining a space between the clothes and the blade after termination of the water supply process, and the rotator performs a washing motion for forming a water flow after the distribution motion control, and the controller may control the driver such that an amount of rotation of the rotator in the distribution motion is less than an amount of rotation of the rotator in the washing motion.

In addition, the laundry treating apparatus may further include a water level sensor disposed inside the tub to measure a water level of the tub, and the controller may control the driver such that the distribution motion is performed only when the water level of the tub is equal to or higher than a distribution reference water level.

Embodiments of the present disclosure may provide the laundry treating apparatus that may reduce the moment of inertia acting on the rotator when the rotator rotates and the driving load of the driver by defining the space between the laundry and the rotator in the initial operation of the washing process.

In addition, embodiments of the present disclosure may provide the laundry treating apparatus in which the driving load of the driver may be reduced to prevent the operation failure of the driver, and the driver may be easily controlled in the washing process.

In addition, embodiments of the present disclosure may provide the laundry treating apparatus in which the driver is easily controlled, so that the rotator that forms the water flow may be efficiently utilized and the washing efficiency may be increased.

In addition, embodiments of the present disclosure may provide the method for controlling the laundry treating apparatus including the distribution motion before the washing motion such that the various washing motions of the rotator may be effectively utilized in the washing process of the clothes.

DETAILED DESCRIPTION

Hereinafter, a specific embodiment of the present disclosure will be described with reference to the drawings. A following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of the prior art related to the present disclosure may unnecessarily obscure the gist of the present disclosure, the detailed description thereof will be omitted. In addition, terms to be described later are terms defined in consideration of functions in the present disclosure, which may vary based on intentions of users and operators, customs, or the like. Therefore, a definition thereof should be made based on a content throughout this specification. The terminology used in the detailed description is for the purpose of describing embodiments of the present disclosure only, and should not be limiting. As used herein, the singular forms 'a' and 'an' are intended to include the plural forms as well, unless the context clearly indicates otherwise. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in describing the components of the embodiment of the present disclosure, terms such as first, second, A, B, (a), (b) may be used. Such terms are only for distinguishing the component from other components, and the essence, order, or order of the component is not limited by the term.

Figure 1:
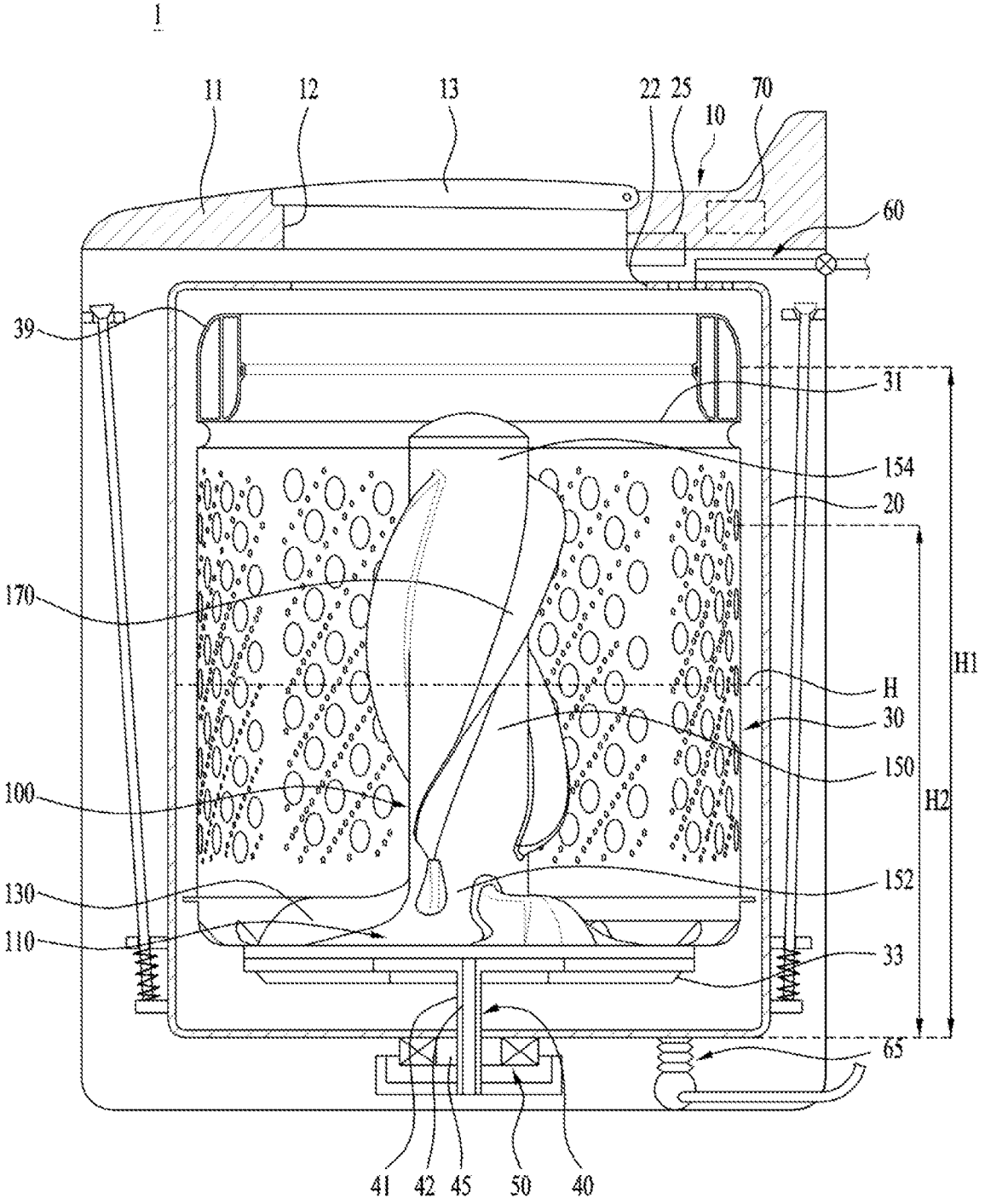
FIG. 1 is a view showing an interior of a laundry treating apparatus according to an embodiment of the present disclosure.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10 according to an embodiment of the present disclosure, and a laundry door 13 for opening and closing the laundry inlet 12 is disposed on the top surface 11.

However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a tub support (not shown). The tub support may be in a structure capable of damping vibrations generated in the tub 20.

The tub 20 is supplied with water through a water supply 60. That is, the water supply 60 may be constructed to provide water to be supplied to the tub 20. The water supply 60 may be composed of a water supply pipe that connects a water supply source with the tub 20, and a water supply valve that opens and closes the water supply pipe.

The water supply 60 may be constructed to supply water to the tub 20 independently or through another component. For example, the water supply 60 may be connected to a detergent feeder 25 to be described later.

When the water supply 60 is connected with the detergent feeder 25, the water supply 60 may supply water to the detergent feeder 25, and the water supplied to the detergent feeder 25 may be delivered to the tub 20. That is, the water supply 60 may be constructed to supply the water to the tub 20 through the detergent feeder 25.

In addition, the water supply 60 may further include a water sprayer. The water sprayer may be constructed to directly spray the water supplied from the water supply pipe into the tub 20. That is, the water supply 60 may be constructed to supply the water into the tub 20 through the water sprayer.

In one example, the laundry treating apparatus 1 according to an embodiment of the present disclosure may include the detergent feeder 25 that may store detergent therein and may supply the detergent to the tub 20. As described above, the detergent feeder 25 may be connected to the water supply 60, and the water supplied from the water supply 60 may be supplied to the tub 20 through the detergent feeder 25.

The detergent feeder 25 may be formed in various shapes having a space in which the detergent is stored. FIG. 1 shows the detergent feeder 25 installed on the top surface 11 of the cabinet 10 according to an embodiment of the present disclosure, but the location of the detergent feeder 25 is not necessarily be limited to the top surface 11 of the cabinet 10.

The water stored in the tub 20 is discharged to the outside of the cabinet 10 through a drain 65. The drain 65 may be composed of a drain pipe that guides the water inside the tub 20 to the outside of the cabinet 10, and a drain pump disposed on the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The top surface 31 of the drum 30 may be opened to form an open surface. The open surface may be formed below the tub opening 22 to be in communication with the tub opening 22.

A plurality of through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the through-holes.

The drum 30 may be rotated by a driver 50. The driver 50 may be constructed to provide a rotational force to the drum 30. That is, the driver 50 may be constructed to rotate the drum 30.

The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, in one embodiment of the present disclosure, the rotation shaft 40 may be disposed to form a right angle with respect to a bottom surface of the tub 20. In this case, the laundry inlet 12 may be defined in the top surface 11 of the cabinet 10, the tub opening 22 may be defined in the top surface of the tub 20, and the open surface of the drum 30 may correspond to the top surface 31 of the drum 30.

In one example, when the drum 30 rotates in a state in which the laundry is concentrated in a certain region inside the drum 30, that is, when a distribution or a uniformity of the distribution of the laundry inside the drum 30 is low, a dynamic unbalance state (an unbalanced state) occurs in the drum 30.

When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, one embodiment of the present disclosure may include a controller 70 that performs a washing process (P100) by controlling the water supply 60, the drain 65, the driver 50, and the like in the washing process (P100) of the clothes.

The washing process (P100) of the clothes may include at least one of a cleaning process (P10), a rinsing process (P20), and a dehydration process (P30). Whether to include the cleaning process (P10), the rinsing process (P20), and the dehydration process (P30) may be determined by the user.

For example, the user may select each process to be included in the washing process (P100) by manipulating a manipulation unit disposed on the cabinet 10 and exposed to the outside. Therefore, combinations of the processes performed in the washing process (P100) of the clothes may be various.

The cleaning process (P10) is a process of removing existing foreign matter from the clothes, that is, the laundry in a state in which detergent is supplied from the detergent feeder 25 into the tub 20 and water is supplied into the tub 20 through the water supply 60.

In the cleaning process (P10), a detergent supply process in which the detergent is supplied or a water supply process (P40) in which the water is supplied may be performed various number of times as needed, and may be performed at various time points as needed. The cleaning process (P10) may include a drainage process (P50) when necessary.

The rinsing process (P20) is a process of discharging the foreign substances remaining in the laundry or separated from the laundry from the inside of the tub 20 in the state in which the water is supplied into the tub 20 through the water supply 60. The foreign substances may be discharged together with the water in the drainage process (P50) in which the water is discharged from the tub 20.

In the rinsing process (P20), the water supply process (P40) in which the water is supplied and the drainage process (P50) in which the water is discharged may be performed various number of times as needed, and may be performed at various time points as needed.

The dehydration process (P30) is a process of removing moisture from the laundry stored inside the drum 30. In the dehydration process (P30), the rotation of the drum 30 and/or the rotator 100 may be performed various number of times in various schemes as needed.

The controller 70 may be configured to control the water supply 60, the drain 65, the detergent feeder 25, the gear set 45, and the like in the washing process (P100). An amount of water supplied by the water supply 60 and an amount of detergent supplied by the detergent feeder 25 may be adjusted through the manipulation unit manipulated by the user, or may be determined through the amount of laundry, the load of the driver 50, and the like.

In one example, in one embodiment of the present disclosure, as shown in FIG. 1, the laundry treating apparatus 1 may further include a rotator 100. The rotator 100 may be rotatably installed on the bottom surface of the drum 30, that is, on a bottom surface 33 inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
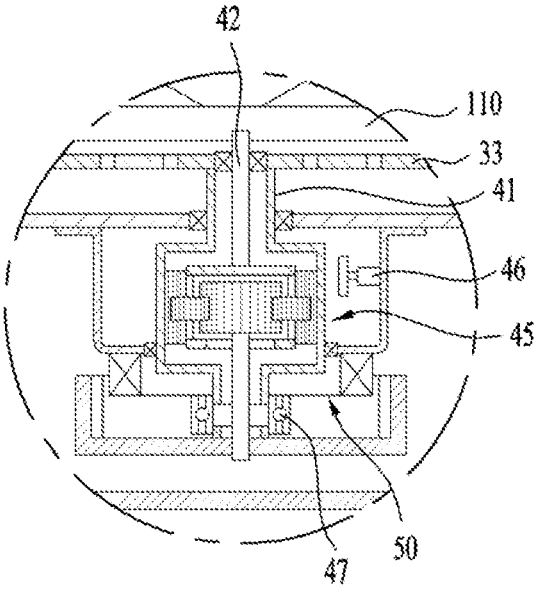
FIG. 2 is a view showing a rotation shaft and a gear set in a laundry treating apparatus according to an embodiment of the present disclosure.

In one example, FIG. 2 shows the rotation shaft 40 coupled with the drum 30 and the rotator 100 according to an embodiment of the present disclosure. Each of the drum 30 and the rotator 100 may be connected to the driver 50 through the rotation shaft 40 to receive a rotational force.

In one embodiment of the present disclosure, the rotation shaft 40 may include a first rotation shaft 41 and a second rotation shaft 42. The drum 30 may be rotated as the first rotation shaft 41 is coupled to the bottom surface thereof, and the rotator 100 may be rotated by being coupled to the second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
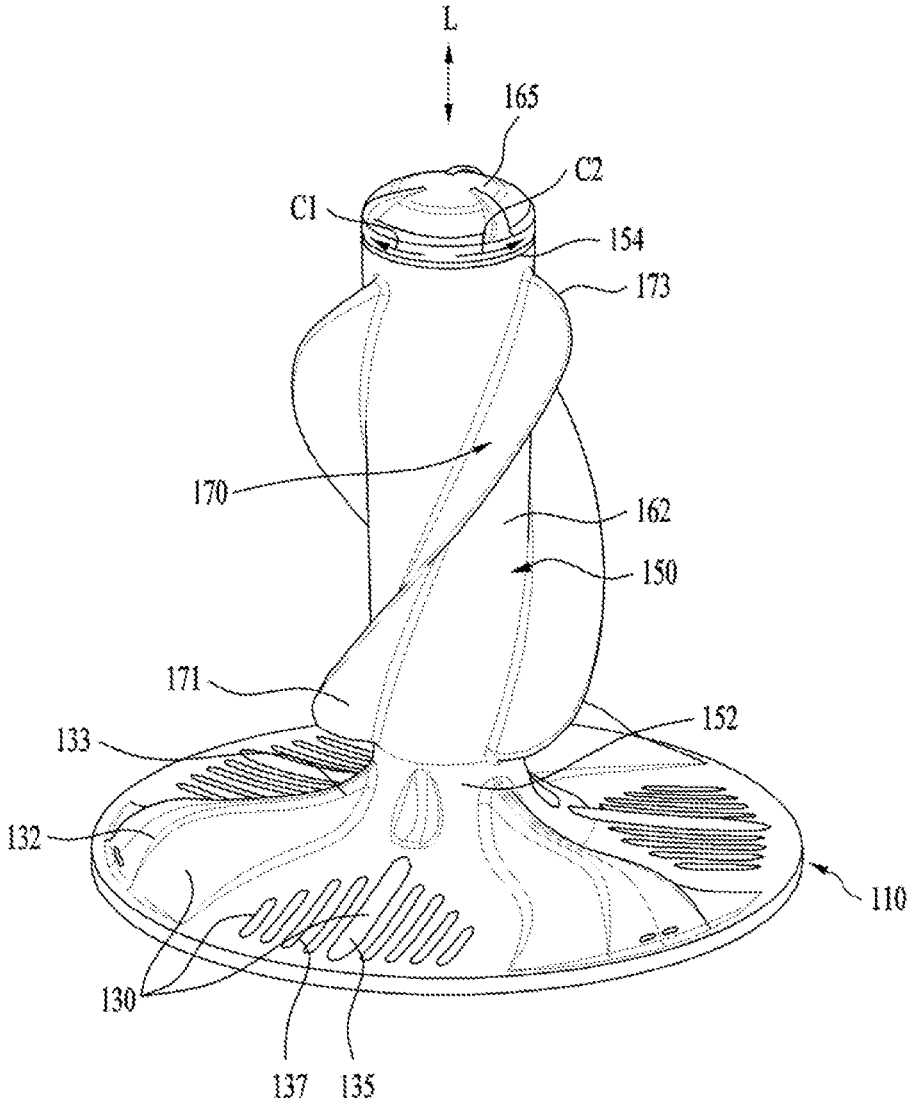
FIG. 3 is a perspective view of a rotator of a laundry treating apparatus according to an embodiment of the present disclosure.

In one example, FIG. 3 is a perspective view of the rotator 100 according to an embodiment of the present disclosure. In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

As the blade 170 extends obliquely, when the rotator 100 is rotated, an ascending or descending water flow may be formed in the water inside the drum 30 by the blade 170 of the pillar 150.

For example, in one embodiment of the present disclosure, the rotator 100 may rotate in one direction C1 and the other direction C2, and the blade 170 may extend from a lower end 171 to an upper end 173 while being inclined toward the other direction C2 with respect to the longitudinal direction L of the pillar 150.

Therefore, when the rotator 100 rotates in said one direction C1, the ascending water flow may be formed by the inclined shape of the blade 170. In addition, when the rotator 100 is rotated in the other direction C2, the descending water flow may be formed by the blade 170.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing motions may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction of the pillar 150, and may extend in the form of the screw from the lower end 171 facing the bottom portion 110 to the upper end 173 facing the open surface 31.

In other words, in one embodiment of the present disclosure, the plurality of blades 170 may extend while being wound on the outer circumferential surface from the lower end 152 facing toward the bottom portion 110 to the upper end 154 facing toward the open surface 31.

Figure 4:
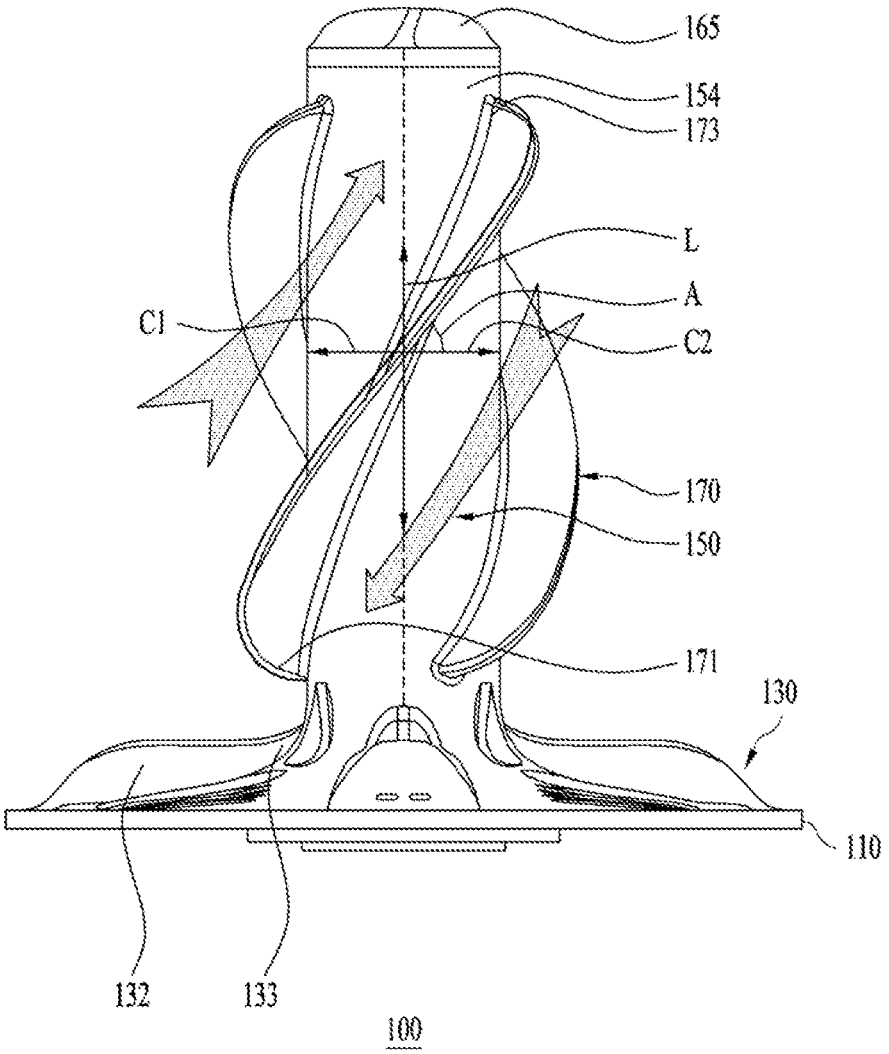
FIG. 4 is a side view of a rotator of a laundry treating apparatus according to an embodiment of the present disclosure.

In one example, FIG. 4 shows a side view of the rotator 100 according to an embodiment of the present disclosure. When referring to FIG. 4, in one embodiment of the present disclosure, the blade 170 may be inclined toward the other direction C2 with respect to the longitudinal direction L of the pillar 150, and may extend from the lower end 171 to the upper end 173.

That is, the blade 170 may be constructed to extend while forming an inclination angle A with respect to the rotation direction of the bottom portion 110 or the rotator 100, and the upper end 173 of the blade 170 may be disposed at a position spaced apart from the lower end 171 of the blade 170 in the other direction C2.

When the inclination direction of the blade 170 is changed from the other direction C2 to said one direction C1 during the extension, during the rotation of the rotator 100, a portion of the blade 170 may generate the ascending water flow and the remaining portion may generate the descending water flow. Thus, it may be difficult to maximize the effect of either ascending or descending of the water.

Accordingly, in one embodiment of the present disclosure, the blade 170 may extend while only being inclined in the other direction C2 with respect to the longitudinal direction L of the pillar 150, the inclination angle A or the specific shape of the blade 170 may be variously determined. Said one direction C1 may be one of a clockwise direction and a counterclockwise direction, and the other direction C2 may be the other one.

In one embodiment of the present disclosure, the blade 170 may continuously extend from the lower end 171 to the upper end 173. The blade 170 may extend from the lower end 171 to the upper end 173 to be continuously inclined with respect to the longitudinal direction L of the pillar 150. That is, the blade 170 may be formed in an inclined shape as a whole without a portion parallel to the longitudinal direction L of the pillar 150.

A length of the pillar 150 may be related to a washing performance and the load of the driver 50. For example, when the length of the pillar 150 is increased, the washing performance may be improved, but an excessive load may be applied to the driver 50. When the length of the pillar 150 is reduced, the load on the driver 50 may be reduced, but the washing performance may also be reduced.

Considering the above relationship, one embodiment of the present disclosure may determine a ratio between the length of the pillar 150 and a diameter of the bottom portion 110. When the length of the pillar 150 is too small, and when an amount of water supplied is large because of a large amount of laundry, because an area in which the water flow is formed by the pillar 150 and the blade 170 is reduced, the washing performance may be deteriorated.

When the length of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In addition, the bottom portion 110 contributes to the formation of the water flow as a protrusion 130 is formed thereon. Therefore, the relationship between lengths of the bottom portion 110 and the pillar 150 determines an effect of the water flow by the bottom portion 110 and an effect of the water flow by the pillar 150.

The protrusion 130 may include each main protrusion 132 having an inner end 133 connected to the pillar 150, and having a greatest height, each first sub-protrusion 135 disposed between a pair of main protrusions 132 and having a height smaller than that of the main protrusion 132, and a plurality of second sub-protrusion 137, each group of which is disposed between each first sub-protrusion 135 and each main protrusion 132, wherein the second sub-protrusion 137 has a height smaller than that of the first sub-protrusion 135.

The diameter of the bottom portion 110 may be variously determined in consideration of a diameter of the pillar 150, sizes of the tub 20 and the drum 30 of the laundry treating apparatus 1, a capacity of the laundry allowed in the laundry treating apparatus 1, an amount of water supplied resulted therefrom, and the like.

The length of the pillar 150 may be variously determined in consideration of a diameter of the drum 30 as well as a height of the drum 30, a diameter of the pillar 150, an inclination angle A of the blade 170, and the like.

Because the bottom portion 110 is positioned on the bottom surface of the drum 30 and rotated, the diameter of the bottom portion 110 with respect to the diameter of the drum 30 needs to be considered. When the diameter of the bottom portion 110 is too small, the effect of the water flow by the rotation of the bottom portion 110 may be too small. When the diameter of the bottom portion 110 is too large, it is easy to cause jamming of the laundry and is disadvantageous in the rotation by the load of the driver 50 and the like.

The diameter of the drum 30 may be variously determined in consideration of the capacity of the laundry allowed in the laundry treating apparatus 1, the amount of water supplied, and a relationship with the tub 20.

In one example, the height of the blade 170 may be determined in consideration of a relationship between an ascending amount and a descending amount of the water flow by the blade 170 and the load of the driver 50.

For example, as the height of the blade 170 becomes smaller, the area in which the blade 170 is formed may be reduced, and the ascending amount and the descending amount of the water flow may be reduced.

In addition, as the height of the blade 170 becomes greater, a water flow forming force by the blade 170 may become stronger, but the load of the driver 50 may be increased. In addition, the height of the blade 170 may be related to the inclination angle A of the blade 170, the diameter of the pillar 150, and the like.

The height of the blade 170 may be variously determined based on the size of the drum 30, the diameter of the bottom portion 110, the height of the pillar 150, the height of the protrusion 130, the position of the cap 165, and the like.

The length extending from the lower end 171 to the upper end 173 along the extension direction of the blade 170 may be defined as an extension length of the blade 170, and the height from the lower end 171 to the upper end 173 of the blade 170 may be defined as a height of the blade 170.

For example, when the number of turns that the blade 170 is wound on the pillar 150 at the same height of the blade 170 is increased, the extension length of the blade 170 is increased.

When the extension length of the blade 170 with respect to the height of the blade 170 becomes larger, a contact area between the blade 170 and the water may increase and the inclination angle A of the blade 170 may be increased. Thus, an influence of the water flow formation on the water may be increased, but the load of the driver 50 may also be increased.

On the other hand, when the extended length of the blade 170 is excessively reduced, the load of the driver 50 may be reduced, but a water flow forming ability may be excessively reduced, thereby reducing the washing efficiency.

The extension length of the blade 170 may be variously determined based on the height of the blade 170, the diameter of the pillar 150, the inclination angle A of the blade 170, a load amount of the driver 50, a water flow formation level, and the like.

In one example, referring to FIG. 4, in one embodiment of the present disclosure, the blade 170 may extend such that the inclination angle A with respect to the circumferential direction of the pillar 150 is uniform. The blade 170 may be disposed on the outer circumferential surface of the pillar 150, extend from the lower end 171 facing toward the bottom portion 110 to the upper end 173 facing toward the top surface 31 of the drum 30, extend in the inclined form with respect to the longitudinal direction L or the circumferential direction of the pillar 150, and extend such that the inclination angle A with respect to the circumferential direction of the pillar 150 is constant.

When the inclination angle A of the blade 170 changes, the inclination angle A of the blade 170 is changed with respect to a vertical level of the pillar 150, so that levels of occurrence of the ascending water flow and the descending water flow may be different. In addition, in the process of forming the blade 170 on the outer circumferential surface of the pillar 150, the change in the inclination angle A of the blade 170 may be disadvantageous in manufacturing and may limit a manufacturing scheme.

For example, when the inclination angle A of the blade 170 is constant, constant ascending water flow and descending water flow formation may be expected over the entire length of the pillar 150, and a mold may be simply rotated and separated in a process of integrally molding the pillar 150 and the blade 170, which may be advantageous in the manufacturing.

In one example, as described above, the laundry treating apparatus 1 according to an embodiment of the present disclosure may include the tub 20, the drum 30, the water supply 60, the detergent feeder 25, the rotator 100, and the driver 50.

The tub 20 may include the space in which the water is stored defined therein, and the drum 30 may be disposed inside the tub 20, may have the open top surface 31 for inserting and withdrawing the clothes therethrough, and may be disposed to be rotatable inside the tub 20.

The water supply 60 may be constructed to provide the water to be supplied to the tub 20, and the detergent feeder 25 may be constructed to supply the detergent to be provided to the tub 20. The rotator 100 may be rotatably installed on the bottom surface 33 of the drum 30.

The driver 50 may be constructed to provide the rotational force to the rotator 100. In addition, the driver 50 may be constructed to provide the rotational force to each of the rotator 100 and the drum 30.

Referring to FIG. 2, as described above, the driver 50 may rotate the rotator 100 and/or the drum 30 through the rotation shaft 40. The rotation shaft 40 may include the first rotation shaft 41 and the second rotation shaft 42, the first rotation shaft 41 may be connected to the drum 30, and the second rotation shaft 42 may be connected to the rotator 100.

The gear set 45 may include the clutch element 46 connected to the driver 50, connected to the first rotation shaft 41 and the second rotation shaft 42 to transmit the power of the driver 50 to the first rotation shaft 41 and the second rotation shaft 42, and selectively constrain the first rotation shaft 41 to the second rotation shaft 42.

The controller 70 may control the rotation directions of the drum 30 and the rotator 100 by controlling the clutch element 46. For example, as described above, the controller 70 may control the second clutch element 48 of the clutch element 46 to synchronize the rotations of the first rotation shaft 41 and the second rotation shaft 42 with each other, or to desynchronize the rotations from each other. The controller 70 may control the driver 50 to determine a washing motion of the rotator 100 and the drum 30.

In one example, the rotator 100 may include the bottom portion 110 located on the bottom surface 33 of the drum 30 and the pillar 150 protruding upward from the bottom portion 110 and having the blade 170 on the outer circumferential surface thereof.

Referring back to FIG. 4, the blade 170 may extend obliquely with respect to the longitudinal direction L of the pillar 150 to form the ascending water flow when the rotator 100 rotates in said one direction C1, and the descending water flow when the rotator 100 rotates in the other direction C2.

That is, the rotator 100 may perform various washing motions using the ascending water flow and the descending water flow generated by the blade 170. Accordingly, the rotator 100 may improve the washing efficiency by forming the three-dimensional water flow. The washing motion may include an ascending and descending motion and a power motion. The ascending and descending motion may include an ascending motion M1 and a descending motion M2.

Figure 5:
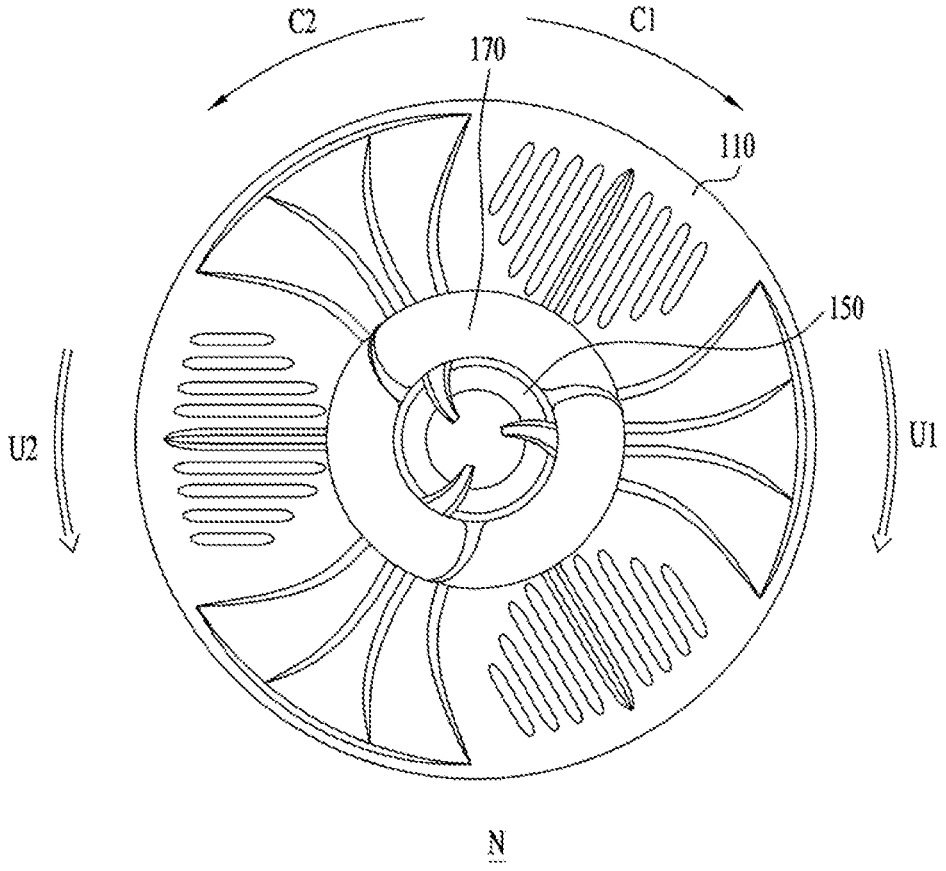
FIG. 5 is a view showing a distribution motion of a rotator in a laundry treating apparatus according to an embodiment of the present disclosure.
Figure 6:
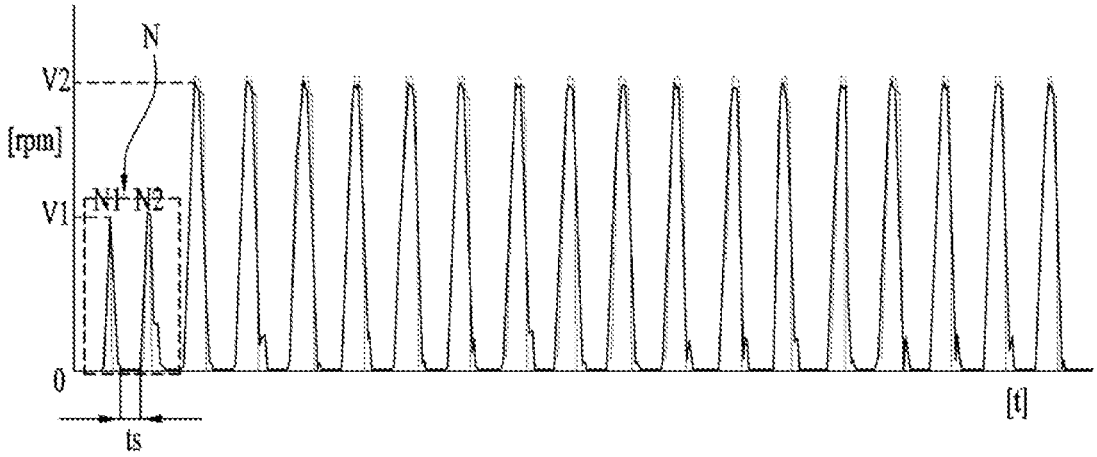
FIG. 6 is a graph showing an amount of rotation of a distribution motion of a rotator in a laundry treating apparatus according to an embodiment of the present disclosure.

FIG. 5 is a view showing a distribution motion of a rotator in a laundry treating apparatus according to an embodiment of the present disclosure. FIG. 6 is a graph showing an amount of rotation of a distribution motion of a rotator in a laundry treating apparatus according to an embodiment of the present disclosure.

Referring to FIGS. 5 and 6, as described above, the laundry treating apparatus 1 according to an embodiment of the present disclosure may include the tub 20 in which the water is stored, the water supply 60 constructed to provide the water to be supplied to the tub 20, the drum 30 disposed inside the tub 20 and having the open top surface 31 for inserting and withdrawing the clothes therethrough, the rotator 100 rotatably installed on the bottom surface 33 of the drum 30, the driver 50 constructed to provide the rotational force to the rotator, and the controller 70 configured to control the driver 50. The rotator 100 may include the bottom portion 110 positioned on the bottom surface 33 of the drum 30 and the pillar 150 protruding upward from the bottom portion 110 and having the blade on the outer circumferential surface 162.

In one example, the washing process (P100) of the clothes of the laundry treating apparatus 1 may include the water supply process (P40) in which the water is supplied into the tub 20 through the water supply 60 at least once. The controller 70 may control the driver 50 such that the rotator 100 performs a distribution motion N after the water supply process P40 is terminated. A space may be defined between the clothes and the blade 170 by the distribution motion N. In addition, the controller 70 may control the driver 50 to perform the washing motion for the rotator 100 to form the water flow after the distribution motion N.

That is, the water supply process (P40) may be a process of providing the water for washing the clothes through the water supply 60. In addition, the rotator 100 may form the three-dimensional water flow using the water supplied through the water supply 60 in the washing motion. The water flow formed by the rotator 100 may allow the laundry to perform a bending and stretching exercise in the washing motion. In addition, the water flow may create friction in the laundry. Accordingly, the laundry may be washed with the contaminants removed through the water supply process (P40) and the washing motion.

Accordingly, the distribution motion N may be performed after the termination of the water supply process (P40) and before the washing motion. That is, in order to wash the clothes, the water may be required, and a process of removing the contaminants by the water flow may be required. The distribution motion N may be performed between the water supply process (P40) and the washing motion to define the space between the clothes and the blade 170.

Accordingly, when the washing motion is performed, a tangling phenomenon between the clothes and the blade 170 and the pillar 150 may be prevented as much as possible. In addition, when the washing motion is performed, it may be easy to form the three-dimensional water flow by the blade 170. Furthermore, the rotator 100 may reduce the moment of inertia acting during the washing motion, and the driver 50 may reduce the driving load for rotating the rotator 100. In addition, the driver 50 may be easily controlled as the driving load is reduced when the washing motion is performed.

In particular, there may be many cases where the water supply process (P40) is performed during the initial operation of the washing process (P100). Accordingly, the initial operation failure of the washing process (P100) may be prevented as much as possible by the distribution motion N performed after the water supply process (P40). Accordingly, the washing efficiency of the laundry treating apparatus 1 may be increased.

The controller 70 may control the driver 50 such that the amount of rotation of the rotator 100 in the distribution motion N is smaller than the amount of rotation of the rotator 100 in the washing motion. In the washing motion, the rotator 100 may be rotated stronger than in the distribution motion N to form the water flow for the washing. In contrast, in the distribution motion, the rotator 100 may rotate weaker than in the washing motion to prevent the tangling of the clothes and define the space between the clothes and the blade 170.

Thus, the rotator 100 may effectively define the space between the clothes and the blade 170 in the distribution motion N. In addition, the rotator 100 may effectively form the water flow for the washing in the washing motion.

Referring to FIG. 6, it is shown that initial two operations of the rotator 100 are performed as the distribution motion. An x-axis of a graph represents a time and a y-axis represents an rpm. In addition, an area in the graph represents the amount of rotation.

The controller 70 may control the driver 50 such that a rotation speed v1 of the rotator 100 in the distribution motion N is lower than a rotation speed v2 of the rotator 100 in the washing motion. That is, a time for which the distribution motion N is performed once and a time for which the washing motion is performed once may be the same. The rotation speed v1 of the rotator 100 in the distribution motion N may be controlled to be lower than the rotation speed v2 of the rotator 100 in the washing motion. Accordingly, the amount of rotation of the rotator 100 in the distribution motion N may be controlled to be smaller than the amount of rotation of the rotator 100 in the washing motion.

That is, in the washing motion, the rotation speed v2 of the rotator 100 may be controlled to be relatively high to form the three-dimensional water flow for the washing. In addition, in the distribution motion N, the rotation speed v1 of the rotator 100 may be controlled to be relatively low in order to maximally prevent the clothes from being tangled with the blade 170 and the pillar 150.

Accordingly, when the washing motion is performed after the distribution motion N, the tangling phenomenon between the clothes and the blade 170 and the pillar 150 may be prevented as much as possible. In addition, when the washing motion is performed, it may be easy to form the three-dimensional water flow by the blade 170. Furthermore, in the rotator 100, the moment of inertia acting during the washing motion may be reduced. In addition, in the driver 50, the driving load for rotating the rotator 100 may be reduced. In addition, the driver 50 may be easily controlled as the driving load is reduced when the washing motion is performed.

FIG. 6 shows that the rotation speed v1 of the rotator 100 in the distribution motion N is equal to or lower than 0.5 times of the rotation speed v2 of the rotator 100 in the washing motion. However, the present disclosure may not be limited thereto, and the rotation speed v1 of the rotator 100 in the distribution motion N may be determined in consideration of the length of the pillar 150, the length of the blade 170, the protruding height of the blade 170, the shape of the blade 170, the diameter of the drum 30, the amount of laundry input, the water level of the tub 20, the rotation speed v2 of the rotator 100 in the washing motion, and the like.

In one example, the tub 20 may have a water level sensor capable of measuring the water level of the tub 20. The controller 70 may determine the water level of the tub 20 through the water level sensor. In addition, the controller 70 may control the driver 50 such that the rotator 100 performs the distribution motion N only when the water level of the tub 20 is equal to or higher than a distribution reference water level H2.

That is, when a large amount of laundry is input during the washing motion, the tangling of the laundry with the blade 170 and the pillar 150 in the rotator 100 by the rotation of the rotator 100 may be increased than when a small amount of laundry is input. That is, it may be preferable that the rotator 100 performs the distribution motion N before the washing motion when the large amount of laundry is input. In other words, in the rotator 100, when the large amount of laundry is input, the effect of reducing the moment of inertia of the rotator 100 and a reduction rate of the driving load of the driver 50 may be increased when performing the washing motion by the distribution motion N than when the small amount of laundry is input.

In addition, when the small amount of laundry is input, in the rotator 100, the tangling phenomenon of the laundry with the blade 170 and the pillar 150 may occur less in the washing motion. Accordingly, the moment of inertia applied to the rotator 100 and the influence on the driving load of the driver 50 resulted from the tangling phenomenon may be ignored.

Accordingly, the controller 70 may control the driver 50 such that the rotator 100 performs the distribution motion N only when the large amount of laundry is input. The controller 70 may determine whether the large amount of laundry is input by determining the water level of the tub 20. The distribution reference water level H2 may be a water level at which the occurrence of the tangling phenomenon of the laundry in the washing motion is rapidly increased.

For example, the distribution reference water level H2 may be determined to be equal to or higher than 0.6 times of a maximum water level H1 of the tub 20 and equal to or lower than 0.8 times of the maximum water level H1 of the tub 20. However, this is only an example, and the determination of the distribution reference water level H2 may be determined as a result of repeated experiments or a theoretical calculation result. The distribution reference water level H2 may be determined in various ways in a strategic aspect of the washing process (P100).

In addition, methods for determining whether the large amount of laundry is input may be various. That is, the tub 20 or the drum 30 has a weight sensor or the like, so that whether the large amount of laundry is input may be determined through the weight sensor. The method for determining whether the large amount of laundry is input may be determined in consideration of the size of the laundry treating apparatus 1, the size of the rotator 100, requirements for use of the laundry treating apparatus 1, and the like.

The distribution motion N may include a first distribution motion N1 in which the rotator 100 is rotated in said one direction C1 and a second distribution motion N2 in which the rotator 100 is rotated in the other direction C2. That is, the controller 70 may control the driver 50 to perform the second distribution motion N2 after performing the first distribution motion N1 in which the rotator 100 is rotated in said one direction C1.

The rotator 100 may prevent the definition of the space between the clothes and the blade 170 and the pillar 150 in the distribution motion N when the rotator 100 is rotated in only one direction. Furthermore, the tangling phenomenon of the clothes may occur in the distribution motion N. Accordingly, the controller may control the driver 50 such that the rotator 100 sequentially performs the first distribution motion N1 and the second distribution motion N2, thereby efficiently defining the space between the clothes and the blade 170 and the pillar 150.

In addition, the order of performing the second distribution motion N2 and the first distribution motion N1 may be variously determined. When the rotator 100 is rotated in said one direction C1 in the washing motion performed after the termination of the distribution motion N, the rotator 100 may perform the first distribution motion N1 first and then perform the second distribution motion N2. Conversely, when the rotator 100 is rotated in the other direction C2 in the washing motion performed after the termination of the distribution motion N, the rotator 100 may perform the second distribution motion N2 first and then perform the first distribution motion N1. The controller 70 may control the driver 50 such that the distribution motion N is terminated in a direction opposite to a direction in which the rotator 100 is rotated in the washing motion. Thus, the tangling phenomenon of the laundry in the washing motion may be effectively prevented.

Each of the first distribution motion N1 and the second distribution motion N2 may be performed once. That is, the first distribution motion N1 and the second distribution motion N2 are performed as few times as possible to reduce the number of driving of the driver 50. Accordingly, the laundry treating apparatus 1 may save power required during operation. Accordingly, FIG. 6 shows that each of the first distribution motion N1 and the second distribution motion N2 is performed once. However, the present disclosure is not limited thereto, and the number of executions of the first distribution motion N1 and the second distribution motion N2 may be variously determined in consideration of the capacity of the laundry, the size of the drum 30, the size of the rotator 100, the length of the pillar 150, the length of the blade 170, the protruding length of the blade 170 in the radial direction of the pillar 150, and the like.

In one example, FIG. 5 conceptually shows a first amount of distribution rotation U1 and a second amount of distribution rotation U2 through arrows. Referring to FIG. 5, in the laundry treating apparatus 1 according to an embodiment of the present disclosure, the rotator 100 may be rotated by the first amount of distribution rotation U1 in the first distribution motion N1. In addition, the rotator 100 may be rotated by the second amount of distribution rotation U2 in the second distribution motion N2.

That is, the controller 70 may control the driver 50 such that the rotator 100 rotates by the first amount of distribution rotation U1 in the first distribution motion N1. In addition, the controller 70 may control the driver such that the rotator 100 rotates by the second amount of distribution rotation U2 in the second distribution motion N2. Furthermore, the controller 70 may control the driver 50 such that the first amount of distribution rotation U1 and the second amount of distribution rotation U2 are the same.

Accordingly, the rotator 100 may define a first space in said one direction C1 between the clothes and the blade 170 and the pillar 150. In addition, the rotator 100 may define a second space having the same area as the first space in the other direction between the clothes and the blade 170 and the pillar 150. In other words, the rotator 100 may define a uniform space along a circumference of the rotator 100.

Accordingly, when the washing motion is performed after the distribution motion N, the tangling phenomenon between the clothes, the blade 170, and the pillar 150 may be prevented as much as possible. In addition, when the washing motion is performed, it may be easy to form the three-dimensional water flow by the blade 170. Furthermore, in the rotator 100, the moment of inertia acting during the washing motion may be reduced. In addition, in the driver 50, the driving load for rotating the rotator 100 may be reduced. In addition, the driver 50 may be easily controlled as the driving load is reduced when the washing motion is performed. In particular, during the initial operation of the washing process (P100), the operation failure may be prevented as much as possible. Furthermore, the washing efficiency of the laundry treating apparatus 1 may be improved.

The amount of rotation of the rotator 100 may mean the rotation angle of the rotator 100. That is, the first amount of distribution rotation U1 may be an angle at which the rotator 100 rotates in the first distribution motion N1. In addition, the second amount of distribution rotation U2 may be an angle at which the rotator 100 rotates in the second distribution motion N2.

For example, the first amount of distribution rotation U1 and the second amount of distribution rotation U2 may be set to be smaller than 180 degrees. This is because, when the rotator 100 is rotated more than 180 degrees, the tangling phenomenon of the clothes with the pillar 150 and the blade 170 may increase. In addition, preferably, the first amount of distribution rotation U1 and the second amount of distribution rotation U2 may be set to be smaller than 90 degrees. This is because, in the rotator 100, the tangling phenomenon of the clothes may be prevented, and a sufficient space may be defined between the clothes and the blade 170 and the pillar 150. In addition, more preferably, the first amount of distribution rotation U1 and the second amount of distribution rotation U2 may be set to be in a range from 15 degrees to 45 degrees. This is because, in this case, in the rotator 100, the tangling phenomenon of the clothes may be prevented, and the sufficient space may be defined between the clothes and the blade 170 and the pillar 150, so that the driving load of the driver 50 may be reduced as much as possible. However, the present disclosure may not be limited thereto, and the first amount of distribution rotation U1 and the second amount of distribution rotation U2 may be determined as a result of repeated experiments or a theoretical calculation result, and may be variously determined in a strategic aspect of the washing process (P100).

For example, the first amount of distribution rotation U1 and the second amount of distribution rotation U2 may be set to be smaller than ¼ (0.25) times a first amount of rotation R1, which will be described later. That is, the first amount of rotation R1 may be set to a value that allows the rotator 100 to form the three-dimensional water flow in the ascending motion M1. Accordingly, the first amount of distribution rotation U1 and the second amount of distribution rotation U2 may be set to be smaller than ¼ (0.25) times the first amount of rotation R1, so that the sufficient space may be defined between the clothes and the blade 170. Accordingly, the rotator 100 may form the three-dimensional water flow while maximally preventing the tangling phenomenon of the clothes in the washing motion. In addition, preferably, the first amount of distribution rotation U1 and the second amount of distribution rotation U2 may be set to be greater than 1/48 times the first amount of rotation R1 and smaller than 1/16 times the first amount of rotation R1. As a result, the rotator 100 may form the three-dimensional water flow while the tangling phenomenon of the clothes is prevented in the washing motion as much as possible, and the driving load of the driver 50 may be reduced as much as possible.

For example, the first amount of distribution rotation U1 and the second amount of distribution rotation U2 may be set to be smaller than ¼ (0.25) times a third amount of rotation R3 to be described later. That is, the third amount of rotation R3 may be set to a value that allows the rotator 100 to form the three-dimensional water flow in the descending motion M2. Accordingly, the first amount of distribution rotation U1 and the second amount of distribution rotation U2 may be set to be smaller than ¼ (0.25) times the third amount of rotation R3, so that the sufficient space may be defined between the clothes and the blade 170 in the distribution motion N. Accordingly, the rotator 100 may form the three-dimensional water flow while preventing the tangling phenomenon of the clothes in the washing motion as much as possible. In addition, preferably, the first amount of distribution rotation U1 and the second amount of distribution rotation U2 may be set to be greater than 1/48 times the third amount of rotation R3 and smaller than 1/16 times the third amount of rotation R3. As a result, the rotator 100 may form the three-dimensional water flow while the tangling phenomenon of the clothes is prevented in the washing motion as much as possible, and the driving load of the driver 50 may be reduced as much as possible. In addition, the first amount of rotation R1 may have the same value as the third amount of rotation R3.

Figure 10:
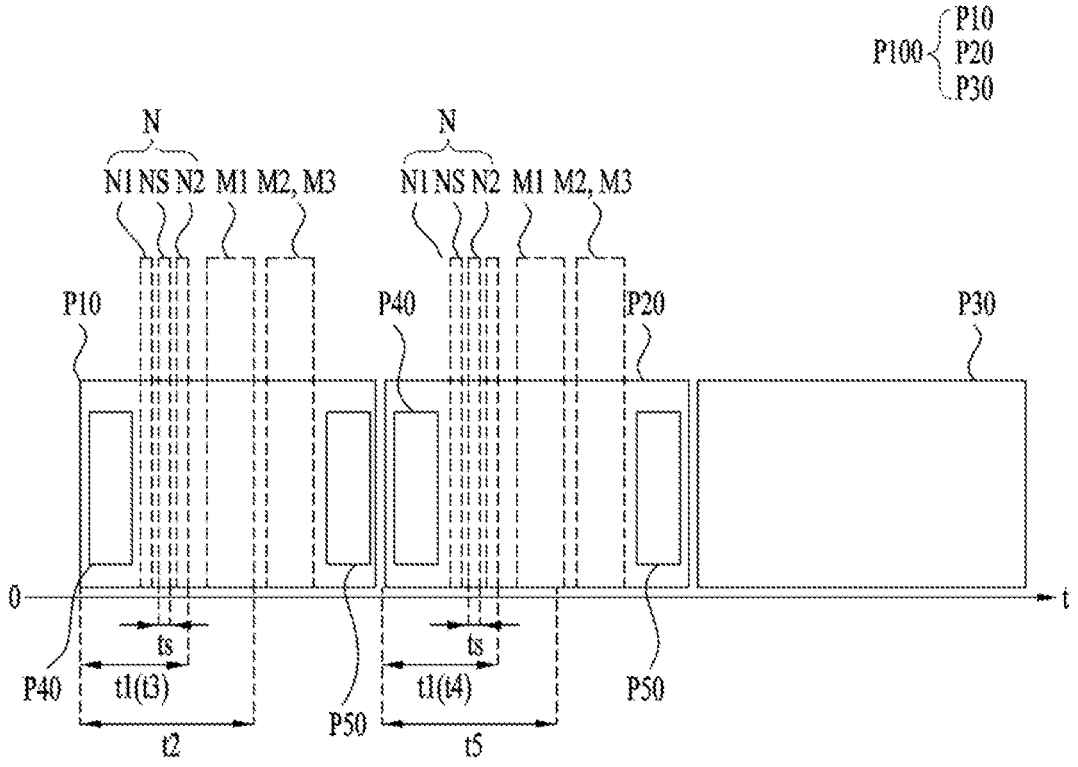
FIG. 10 is a view showing a washing process of clothes in a laundry treating apparatus according to an embodiment of the present disclosure.

In one example, FIG. 10 is a conceptual operation flowchart of the washing process (P100) of the clothes by the laundry treating apparatus 1 according to an embodiment of the present laundry disclosure. In FIG. 10, a horizontal axis is an axis of a time t.

FIG. 10 shows the cleaning process (P10), the rinsing process (P20), and the dehydration process (P30), and shows the water supply process (P40) or the like that may be performed in each process. A section in which one of the plurality of washing motions may be performed is indicated by a dotted line area. However, in one embodiment of the present disclosure, the washing process (P100) is not necessarily limited to the content shown in FIG. 10.

In one embodiment of the present disclosure, as described above, the washing process (P100) may include at least one of the cleaning process (P10), the rinsing process (P20), and the dehydration process (P30), and the number of executions of each process or an execution order of the processes may vary.

Referring to FIG. 10, the washing process (P100) may include the water supply process (P40) in which the water is supplied into the tub 20 through the water supply 60 at least once, and the controller 70 may control the driver 50 such that the rotator performs the distribution motion N within a water supply distribution reference time t1 after the termination of the water supply process P40. In addition, the controller 70 may control the driver 50 such that the rotator 100 performs the washing motion within a water supply washing reference time t2 after the distribution motion N. The rotator 100 performing the washing motion within the water supply washing reference time t2 after the distribution motion N may mean that the rotator 100 performs the ascending and descending motion to be described later within the water supply washing reference time t2 after the distribution motion N.

The water supply process (P40) may be included in at least one of the cleaning process (P10), the rinsing process (P20), and the dehydration process (P30), or may be performed independently. FIG. 10 shows a state in which the water supply process (P40) is performed in each of the cleaning process (P10) and the rinsing process (P20).

In FIG. 10, it is shown that the water supply process (P40) is performed once in each of the cleaning process (P10) and the rinsing process (P20), but this is only for convenience of description, and the present disclosure is not necessarily limited as shown in FIG. 10. The number of executions or an execution time of the water supply process P40 may be variously set as needed.

In the water supply process (P40), the water supplied from the water supply 60 may be provided into the tub 20. When the water is introduced into the tub 20 through the cleaning process (P10) as well as the rinsing process (P20) and the water supply process (P40), the rotator 100 may define the space between the clothes and the rotator 100. After the space is defined, an active mixing process between the laundry and the water put into the tub 20 through the formation of the three-dimensional water flow using the rotator 100 may improve the washing efficiency.

Therefore, in one embodiment of the present disclosure, the controller 70 may control the driver 50 such that the distribution motion N is performed within the water supply distribution reference time t1 after the termination of the water supply process (P40), and the rotator 100 performs the washing motion within the water supply washing reference time t2 after the distribution motion N. The numbers of executions of the distribution motion N and the washing motion may be variously determined as needed.

The water supply distribution reference time t1 may be a time preset in the controller 70, and may be a time from the start of the water supply process (P40) to a time point at which the distribution motion N is terminated after being repeatedly performed by the controller 70. In addition, the water supply washing reference time t2 may be a time preset in the controller 70, and may be a time from the start of the water supply process (P40) to a time point at which the washing motion is terminated after being repeatedly performed by the controller 70. FIG. 10 shows the water supply distribution reference time t1 and the water supply washing reference time t2 conceptually.

In one embodiment of the present disclosure, the washing process (P100) may include the cleaning process (P10) in which the detergent is supplied from the detergent feeder 25 into the tub 20 and the foreign substances are removed from the clothes. As described above, the cleaning process P10 may include the water supply process P40 at least once.

The controller 70 may control the driver 50 such that the rotator 100 performs the distribution motion N within a cleaning distribution reference time t3 after the start of the cleaning process (P10). In FIG. 10, a section in which the distribution motion N is performed within the cleaning distribution reference time t3 after the start of the cleaning process P10 according to an embodiment of the present disclosure is shown as a dotted line area.

After the start of the cleaning process (P10), the water and the detergent may be supplied into the tub 20 or the drum 30. At the beginning of the cleaning process (P10), the detergent needs to be mixed with the water and the laundry. The rotator 100 may define the space between the clothes and the blade 170 and the pillar 150 in order to increase a mixing effect of the detergent with the water and the laundry.

Therefore, one embodiment of the present disclosure allows the distribution motion N to be performed within the cleaning distribution reference time t3 after the start of the cleaning process (P10), so that rapid dissolution of the detergent may be induced and a moisture content and a detergent response of the entire laundry may be increased. Furthermore, even in the washing motion performed after the distribution motion N, it is possible to induce the rapid dissolution of the detergent and further increase the moisture content and the detergent response of the entire laundry.

The cleaning distribution reference time t3 may be a time preset in the controller 70, and may be a time from the start of the cleaning process (P10) to a time point at which the distribution motion N is terminated after being repeatedly performed by the controller 70 at the beginning of the cleaning process (P10). FIG. 10 shows the cleaning distribution reference time t3 conceptually.

In one example, the washing process (P100) may further include the rinsing process (P20) in which the water is supplied from the water supply 60 to the tub 20 and the foreign substances are discharged from the tub 20 after the cleaning process (P10).

FIG. 10 shows the rinsing process (P20) performed after the cleaning process (P10) conceptually. However, the number of executions or an order of the rinsing process (P20) is not necessarily limited thereto.

The controller 70 may control the driver 50 such that the rotator 100 performs the distribution motion N within a rinsing distribution reference time t4 after the start of the rinsing process (P20). FIG. 10 shows a section in which the distribution motion N is performed within the rinsing distribution reference time t4 in the rinsing process (P20).

At the beginning of the rinsing process (P20), the water supply process (P40) in which the water is supplied into the drum 30 may be performed. In the laundry, the foreign substances may remain after the cleaning process (P10). Therefore, it may be advantageous for a rinsing efficiency to flow the laundry through the formation of the three-dimensional water flow and to allow the water flow to pass through the laundry. The rotator 100 may flow the laundry through the formation of the three-dimensional water flow, and define the space between the clothes and the blade 170 and the pillar 150 to facilitate the flow of water through the laundry.

Therefore, in one embodiment of the present disclosure, the controller 70 may control the driver 50 such that the rotator 100 performs the distribution motion N within the rinsing distribution reference time t4 after the start of the rinsing process P20.

The rinsing distribution reference time t4 may be a time preset in the controller 70, and may be a time from the start of the rinsing process (P20) to a time point at which the distribution motion N is terminated after being repeatedly performed by the controller 70 at the beginning of the rinsing process (P20). FIG. 10 shows the rinsing distribution reference time t4 conceptually. In addition, the water supply distribution reference time t1 may be set to be the same as or different from the cleaning distribution reference time t3 and the rinsing distribution reference time t4.

In one example, referring to FIG. 10, the distribution motion N according to an embodiment of the present disclosure may include the first distribution motion N1, the second distribution motion N2, and a stop motion NS. The controller 70 may perform the stop motion NS after the first distribution motion N1, and perform the second distribution motion N2 after the stop motion NS. The clothes receive an inertia force in said one direction C1 by the first distribution motion N1. Accordingly, when the second distribution motion N2 is performed immediately after the first distribution motion N1, the rotator 100 may prevent the space from being defined between the clothes and the blade 170 by the inertial force.

The controller 70 may control the driver 50 such that the rotator 100 performs the stop motion NS after the first distribution motion N1, thereby preventing the influence of the inertia force as much as possible. In addition, when the second distribution motion N2 is performed first, the controller 70 may perform the stop motion NS after the second distribution motion N2, and perform the first distribution motion N1 after the stop motion NS.

The stop motion NS may be performed for a stop reference time ts. The stop reference time ts may be a time during which the inertia force by the first distribution motion N1 or the second distribution motion N2 may be removed after the first distribution motion N1 or the second distribution motion N2 is performed. The stop reference time is may be determined as a result of a repeated experiment or a theoretical calculation result, and may be variously determined in a strategic aspect of the washing process (P100).

Figure 7:
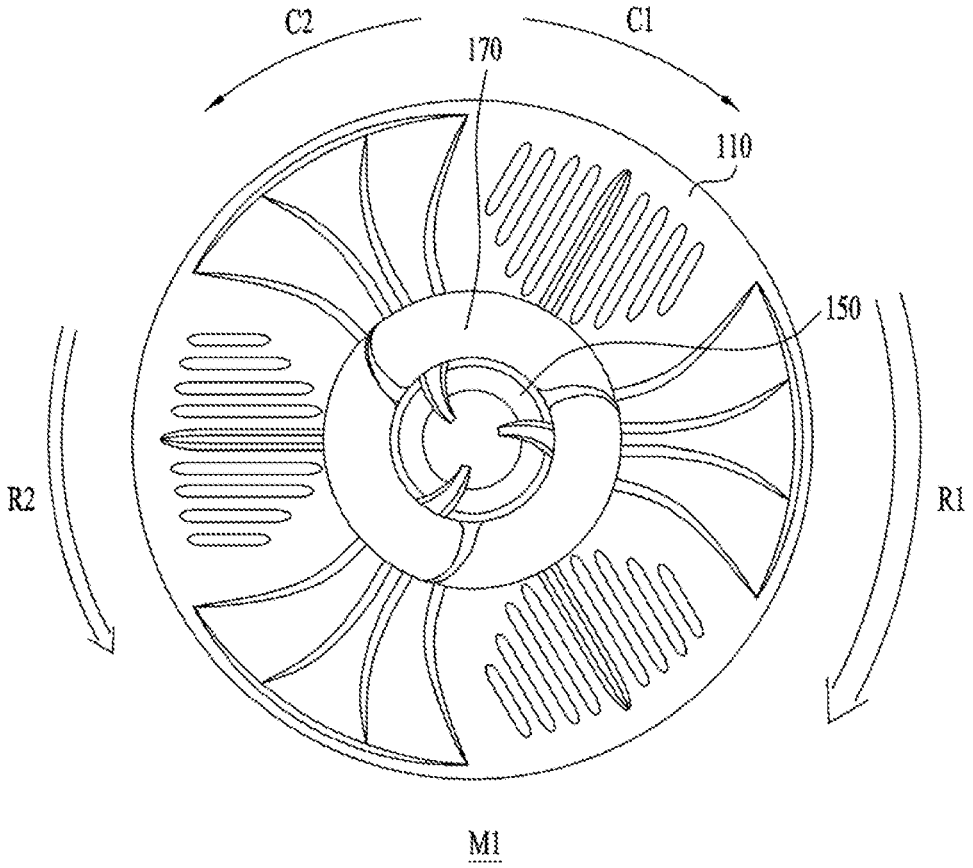
FIG. 7 is a view showing an ascending motion of a rotator in a laundry treating apparatus according to an embodiment of the present disclosure.
Figure 8:
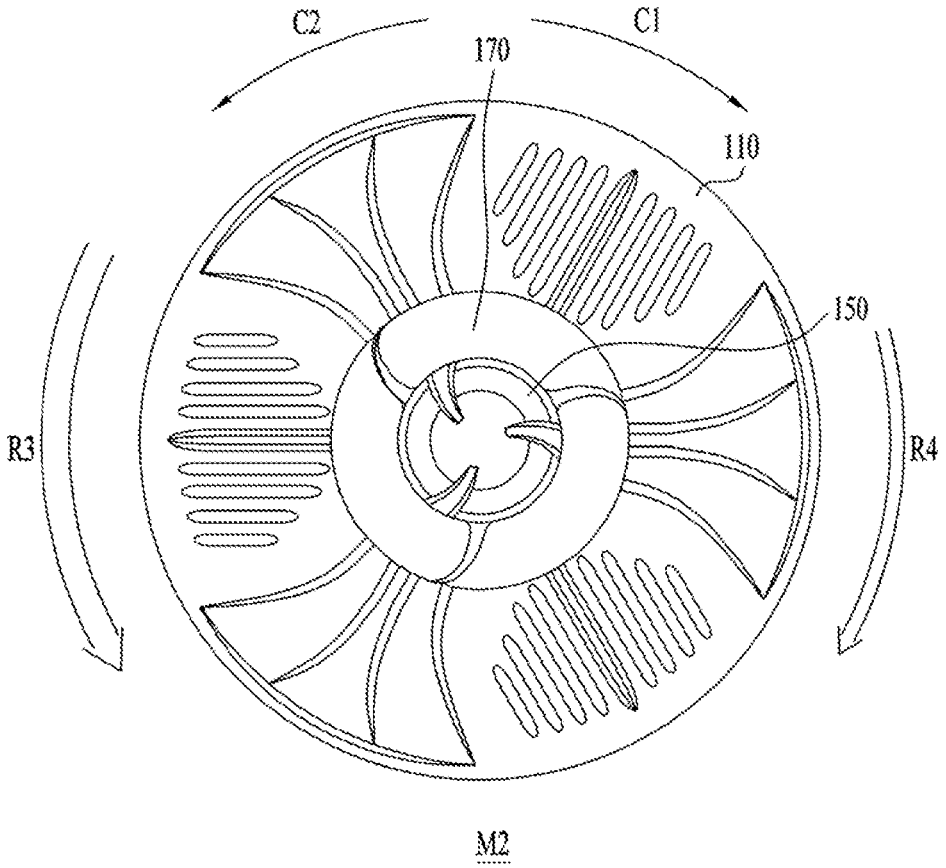
FIG. 8 is a view showing a descending motion of a rotator in a laundry treating apparatus according to an embodiment of the present disclosure.

FIG. 7 is a view showing an ascending motion of a rotator in a laundry treating apparatus according to an embodiment of the present disclosure. FIG. 8 is a view showing a descending motion of a rotator in a laundry treating apparatus according to an embodiment of the present disclosure.

Referring to FIGS. 7 and 8, the washing motion in the laundry treating apparatus according to an embodiment of the present disclosure may include the ascending and descending motion for forming the descending water flow. The controller 70 may control the driver 50 such that the rotator 100 performs the ascending and descending motion for forming the ascending water flow or the descending water flow at least once in the washing process (P100) of the clothes.

Specifically, in one embodiment of the present disclosure, the ascending and descending motion may form the ascending water flow or the descending water flow as a result of one cycle. As the blade 170 is extended while being inclined in the other direction C2 as described above, the ascending water flow may be formed in the water inside the tub 20 when the rotator 100 rotates in said one direction C1, and the descending water flow may be formed when the rotator 100 rotates in the other direction C2.

In one embodiment of the present disclosure, various washing motions of the rotator 100 may be performed, and the washing motion of the rotator 100 may be implemented as the controller 70 controls the driver 50. In one embodiment of the present disclosure, each washing motion may include a plurality of rotations with different rotation directions in one motion cycle. The various washing motions may be preset in the controller 70, and the controller 70 may control the driver 50 based on the set washing motion.

The controller 70 may control the driver 50 such that the rotation in said one direction C1 and the rotation in the other direction C2 of the rotator 100 are performed with different amounts of rotation in the ascending and descending motion.

That is, in one embodiment of the present disclosure, the ascending and descending motion may be composed of one cycle by including the rotation in said one direction C1 of the rotator 100 together with the rotation in the other direction C2. The number of executions of the rotation in said one direction C1, the number of executions of the rotation in the other direction C2, and the amount of rotation may be variously determined.

In one example, in one embodiment of the present disclosure, the ascending and descending motion may ultimately implement the water flow characteristics required in the ascending and descending motion through a difference in the amount of rotation between the rotation in said one direction C1 and the rotation in the other direction C2 of the rotator 100.

For example, through the control of the driver 50 by the controller 70 in the ascending motion M1 of the ascending and descending motion, the rotator 100 may be rotated such that the amount of rotation in said one direction C1 is greater than the amount of rotation in the other direction C2.

The rotator 100 forms the ascending water flow when rotating in said one direction C1 and forms the descending water flow when rotating in the other direction C2. The rotator 100 eventually rotates in the ascending motion M1 such that the amount of rotation in said one direction C1 is greater than the amount of rotation in the other direction C2, so that, when the ascending motion M1 of the rotator 100 is performed, eventually the ascending water flow may be formed.

In addition, through the control of the driver 50 by the controller 70 in the descending motion M2 of the ascending and descending motion, the rotator 100 may rotate such that the amount of rotation in the other direction C2 is greater than the amount of rotation in said one direction C1.

The rotator 100 rotates in the descending motion M2 such that the amount of rotation in the other direction C2 is greater than the amount of rotation in said one direction C1, so that it may be understood that the descending water flow has ultimately formed when the descending motion M2 of the rotator 100 is performed.

In one embodiment of the present disclosure, because the rotation in said one direction C1 and the rotation in the other direction C2 are performed together in one cycle of the ascending and descending motion, a curling phenomenon in which the laundry is wound on the pillar 150 may be minimized.

For example, when the rotator 100 rotates in only one direction of said one direction C1 and the other direction C2 in the ascending and descending motion, the ascending water flow or the descending water flow may be formed, but the laundry around the pillar 150 may be wound by the rotation of the rotator 100, so that the load of the driver 50 may be increased, and the washing efficiency may be reduced as the flow of the laundry is lowered, and subsequent rotation of the pillar 150 may be restricted.

Therefore, in one embodiment of the present disclosure, as the rotation in said one direction C1 and the rotation in the other direction C2 are performed together in the ascending and descending motion for forming the ascending water flow or the descending water flow, the curling of the laundry may be minimized, and through the deviation of the amount of rotation between the rotation in said one direction C1 and the rotation in the other direction C2, the water flow may be efficiently formed in the corresponding motion, thereby improving the washing efficiency.

In the ascending and descending motion, the number of executions of the rotation in said one direction C1 and the number of executions of the rotation in the other direction C2 may be variously determined, and the order of the rotations may also be variously determined. Each amount of rotation of the rotation in said one direction C1 and the rotation in the other direction C2 may also be variously determined as needed.

In the present disclosure, the amount of rotation of the rotator 100 may be understood as a rotation angle. For example, in the ascending and descending motion, the rotator 100 may be rotated by a first rotation angle in said one direction C1 and rotated by a second rotation angle in the other direction C2.

The driver 50 may rotate the rotator 100 such that the rotator 100 performs the ascending and descending motion for forming the ascending water flow or the descending water flow at least once. In the ascending and descending motion, the driver 50 may rotate the rotator 100 such that the rotator 100 rotates by different amounts of rotation along said one direction C1 and the other direction C2.

Because the rotation of the rotator 100 is made by the driver 50 and the driver 50 is driven by the control to the controller 70, the rotation of the rotator 100 may eventually be controlled by the controller 70.

The controller 70 may control the rotation of the driving shaft of the driver 50 by adjusting a current or a voltage provided to the driver 50, and there may be various methods for the controller 70 to control the rotation of the driver 50. The driver 50 may be constructed such that a rotation angle thereof or the like is adjustable, like as a step motor or the like.

In one example, as described above, in one embodiment of the present disclosure, the plurality of blades 170 may be disposed to be spaced apart from each other along the circumferential direction of the pillar 150, may be inclined in the other direction C2 with respect to the longitudinal direction L of the pillar 150, and may extend from the lower end 152 toward the upper end 154 of the pillar 150.

Accordingly, as shown in FIG. 4, when the rotator 100 is rotated in said one direction C1, the ascending water flow may be formed by the blade 170. When the rotator 100 is rotated in the other direction C2, the descending water flow may be formed.

In one example, referring to FIG. 7, in one embodiment of the present disclosure, the ascending and descending motion may include the ascending motion M1 for forming the ascending water flow. The controller 70 may control the driver 50 such that, in the ascending motion M1, the rotator 100 rotates in said one direction C1 by the first amount of rotation R1, and rotates in the other direction C2 by the second amount of rotation R2 smaller than the first amount of rotation R1.

As described above, in one embodiment of the present disclosure, the ascending and descending motion among the washing motions may include the ascending motion M1 and the descending motion M2. The ascending motion M1 may ultimately form the ascending water flow through the complex rotation of the rotator 100.

In the ascending motion M1, the rotator 100 may be rotated in said one direction C1 by the first amount of rotation R1, and rotated in the other direction C2 by the second amount of rotation R2. The second amount of rotation R2 may correspond to an amount of rotation smaller than the first amount of rotation R1.

FIG. 7 conceptually shows the first amount of rotation R1 and the second amount of rotation R2 by arrows. In the ascending motion M1, the rotator 100 rotates such that the first amount of rotation R1 is greater than the second amount of rotation R2, so that the ultimate water flow resulted from the ascending motion M1 may be understood as the ascending water flow.

As described above, in one embodiment of the present disclosure, the driver 50 may be constructed to rotate the rotator 100 as above, and the operation of the driver 50 may be controlled by the controller 70.

In one example, in one embodiment of the present disclosure, the controller 70 may control the driver 50 such that the rotator 100 rotates in the other direction C2 after rotating in said one direction C1 in the ascending motion M1.

In the ascending motion M1, the first amount of rotation R1 is greater than the second amount of rotation R2, and thus, one cycle of the ascending motion M1 is terminated in a state in which the rotator 100 is rotated by the relatively large first amount of rotation R1 when the rotation in said one direction C1 is performed after the rotation in the other direction C2, so that the ascending motion M1 may be terminated in the state in which the laundry is curled in the rotation by the first amount of rotation R1.

That is, one embodiment of the present disclosure allows the rotation in said one direction C1 with the greater amount of rotation to be performed before the rotation in the other direction C2 in the ascending motion M1, thereby resolving the curling phenomenon of the laundry that may occur in the rotation in said one direction C1 through the rotation in the other direction C2.

In one embodiment of the present disclosure, the descending motion M2 may also eliminate the curling phenomenon of the laundry as the rotation in the other direction C2 with the greater amount of rotation is performed before the rotation in said one direction C1.

In one example, referring to FIG. 10, the washing motion by the rotator 100 according to an embodiment of the present disclosure may include the ascending motion M1, the descending motion M2, and a power motion M3. In addition, after the cleaning process (P10) is started, the water and the detergent may be supplied into the tub 20 or the drum 30. At the beginning of the cleaning process (P10), the detergent needs to be mixed with the water and the laundry.

The controller 70 may control the driver 50 such that the rotator 100 performs the ascending motion M1 at least once after the cleaning process (P10) starts. The ascending motion M1 may form the ascending water flow, and may induce an upward movement of laundry located at a lower portion of the drum 30 of the entire laundry. That is, by performing the ascending motion M1, a vertical flow of the laundry may be generated. The ascending motion M1 may be accompanied by the formation of the ascending water flow in an upward direction in the drum 30 as well as a formation of a different rotating water flow in the circumferential direction of the pillar 150. At the beginning of the cleaning process (P10), the rapid dissolution of the detergent may be required, and the moisture content and the detergent response of the entire laundry may be required.

Therefore, one embodiment of the present disclosure allows the distribution motion N to be performed at least once after the start of the cleaning process (P10), so that the rapid dissolution of the detergent may be induced and the moisture content and the detergent response of the entire laundry may be increased.

In addition, as described above, the controller 70 may control the driver such that the distribution motion N is performed first after the start of the cleaning process P10 and then the ascending motion M1 is performed. In addition, the distribution motion N may not be necessarily performed, and whether to perform the distribution motion N may be determined in consideration of the amount of laundry, the water level of the tub 20, the type of washing process (P100), and the like.

In one example, the washing process (P100) may further include the rinsing process (P20) in which water is supplied to the tub 20 from the water supply 60 after the cleaning process (P10) and the foreign substances are discharged from the tub 20.

The controller 70 may control the driver 50 such that the rotator 100 performs the ascending motion M1 at least once after the rinsing process (P20) starts.

At the beginning of the rinsing process (P20), the water supply process (P40) in which the water is supplied into the drum 30 may be performed. In the laundry, the foreign substances may remain after the cleaning process (P10). Therefore, it may be advantageous for the rinsing efficiency to flow the laundry through the formation of the three-dimensional water flow and to allow the water flow to pass through the laundry.

Therefore, in one embodiment of the present disclosure, after the rinsing process (P20) starts, the controller 70 may control the driver 50 such that the rotator 100 performs the ascending motion M1 at least once.

In addition, as described above, the controller 70 may control the driver such that the distribution motion N is performed first after the rinsing process P20 is started and then the ascending motion M1 is performed. In addition, the distribution motion N may not be necessarily performed, and whether to perform the distribution motion N may be determined in consideration of the amount of laundry, the water level of the tub 20, the type of washing process (P100), and the like.

In one example, FIG. 8 shows the descending motion M2 of the ascending and descending motion of the laundry treating apparatus 100 according to an embodiment of the present disclosure. Referring to FIG. 8, in one embodiment of the present disclosure, the ascending and descending motion includes the descending motion M2 for forming the descending water flow. The controller 70 may control the driver 50 such that, in the descending motion M2, the rotator 100 rotates in the other direction C2 by a third amount of distribution rotation R3, and rotates in said one direction C1 by a fourth amount of rotation R4 smaller than the third amount of distribution rotation R3.

In the descending motion M2, the amount of rotation in the other direction C2 is set to be greater than the amount of rotation in said one direction C1, so that the effect of the descending water flow may be ultimately induced. In the descending motion M2, the rotator 100 may be rotated by the third amount of distribution rotation R3 in the other direction C2 and may be rotated by the fourth amount of rotation R4 in said one direction C1.

The third amount of distribution rotation R3 may have a higher value than the fourth amount of rotation R4. For example, the third amount of distribution rotation R3 may correspond to a rotation angle of 720 degrees of the rotator 100, and the fourth amount of rotation R4 may correspond to a rotation angle of 360 degrees of the rotator 100. The third amount of distribution rotation R3 may be equal to or greater than 150% and equal to or smaller than 200% of the fourth amount of rotation R4.

However, the first amount of rotation R1 and the second amount of rotation R2 in the ascending motion M1 are independent of the third amount of distribution rotation R3 and the fourth amount of rotation R4. For example, the first amount of rotation R1 and the third amount of distribution rotation R3 may be the same or different, and the second amount of rotation R2 and the fourth amount of rotation R4 may be the same or different.

However, the above numeric values are only presented as an example for convenience of description, and do not limit one embodiment of the present disclosure. A ratio between the rotation angle of the rotator 100 and the amount of rotation may be variously set as needed.

The descending motion M2 of the present disclosure may ultimately have an effect of forming the descending water flow as the rotation in the other direction C2 of the rotator 100 forming the descending water flow has the greater amount of rotation than the rotation in said one direction C1 forming the ascending water flow, and may improve a uniformity of distribution of the clothes and ameliorate the curling phenomenon of the laundry as the rotation in the other direction C2 and the rotation in said one direction C1 are performed together in one cycle.

In one example, in one embodiment of the present disclosure, the controller 70 may control the driver 50 such that the rotator 100 performs the descending motion M2 at least once only when the amount of water supplied to the tub 20 during the washing process P100 is equal to or greater than a reference water supply amount.

In FIG. 1, a water surface in the tub 20 based on the reference water supply amount is exemplarily shown. In one embodiment of the present disclosure, when the amount of water supplied into the tub 20 is equal to or less than the reference water supply amount, the performance of the descending motion M2 of the rotator 100 may be limited.

The descending motion M2 may move the laundry and the water downward around the pillar 150. In a case in which a water level inside the tub 20 is too low, when the descending motion M2 is performed, a flow efficiency of the laundry may be excessively reduced because a distance between the laundry and the bottom portion 110 or the bottom surface 33 of the drum 30 is too small, and jamming of the laundry at a location between the bottom portion 110 and the bottom surface 33 of the drum 30 and may be induced, which is disadvantageous.

Therefore, in one embodiment of the present disclosure, a reference of the water supply amount with which the flow of the laundry by the descending motion M2 may be effectively made, and the laundry jamming and the like may be sufficiently suppressed as the reference water supply amount, and the rotator 100 may perform the descending motion M2 with the water supply amount equal to or greater than the reference water supply amount.

The reference water supply amount may be determined as a result of repeated experiments or a theoretical calculation result, and may be determined variously in a strategic aspect of the washing process (P100).

The controller 70 may determine the amount of water supplied to the tub 20 variously. For example, the water supply amount based on a water supply execution time of the water supply 60 may be stored in advance in the controller 70 in a form of a data map, and the controller 70 may determine the water supply amount based on the data map.

Alternatively, the water supply 60 may be constructed such that a water supply amount for each unit time may be adjusted, and the controller 70 may adjust the mount of water supplied into the tub 20 while adjusting the water supply amount for each unit time together with a water supply time.

Alternatively, the tub 20 may have a water level sensor that may measure the water level, and the controller 70 may identify the water supply amount through a water level with respect to a currently supplied water amount through the water level sensor.

One embodiment of the present disclosure may set the reference water supply amount appropriate and efficient to perform the descending motion M2, and may effectively improve the washing efficiency by performing the descending motion M2 of the rotator 100 with the water supply amount equal to or greater than the reference water supply amount.

In FIG. 10, a plurality of dotted line areas in which the washing motions of the rotator 100 are performed are indicated, and a dotted line area in which the descending motion M2 may be performed with the water supply amount equal to or greater than the reference water supply amount is indicated. The descending motion M2 may be used in the cleaning process (P10), the rinsing process, or the like.

However, the dotted line area shown in FIG. 10 is for convenience of description. The descending motion M2 may be performed various number of times in various sections in the washing process (P100).

Figure 9:
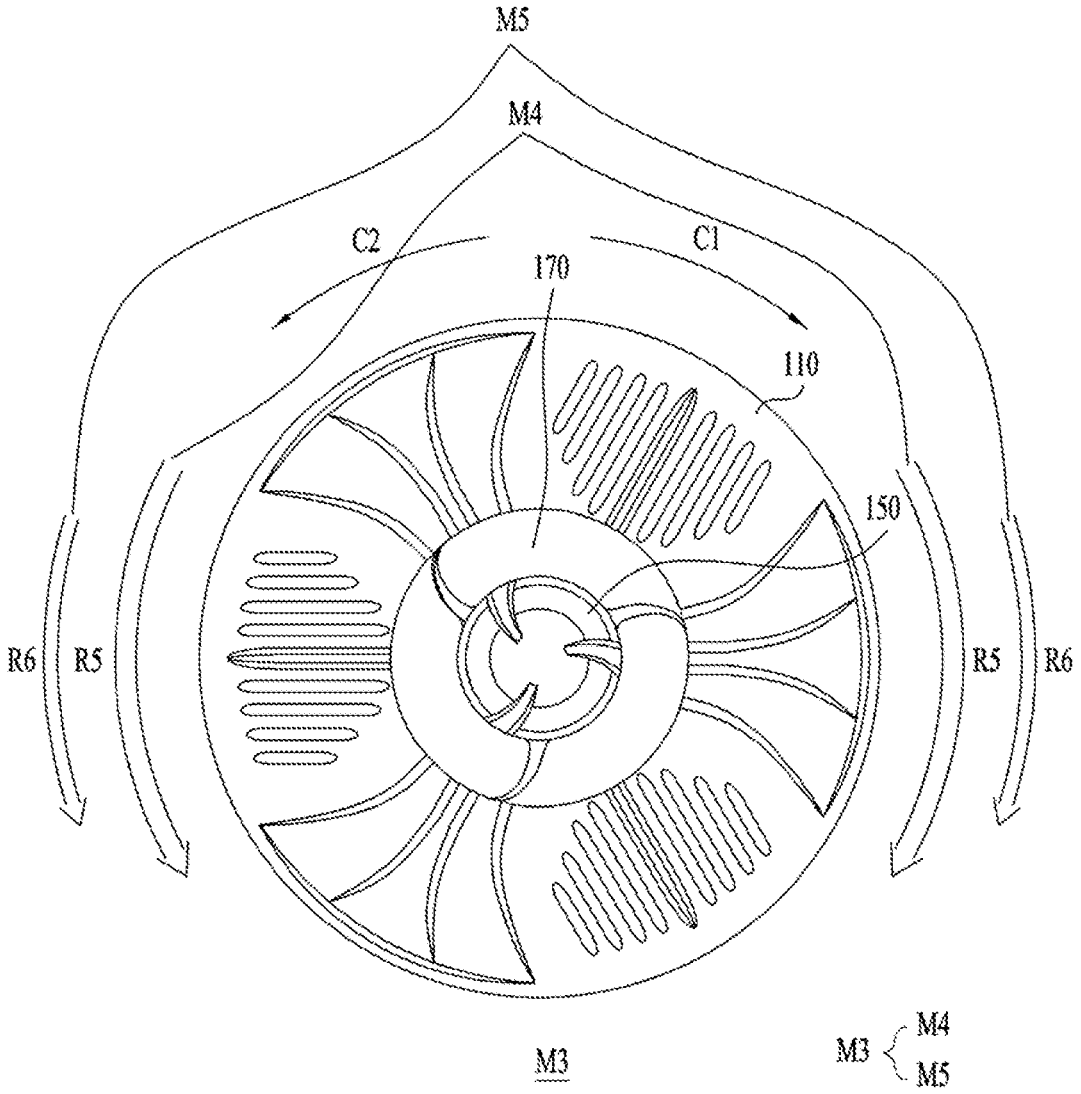
FIG. 9 is a view showing a power motion of a rotator in a laundry treating apparatus according to an embodiment of the present disclosure.

In one example, FIG. 9 is a view showing a power motion of a rotator in a laundry treating apparatus according to an embodiment of the present disclosure.

Referring to FIG. 9, in the laundry treating apparatus according to an embodiment of the present disclosure, the controller 70 may control the driver 50 such that the rotator 100 performs the power motion M3 for forming a stronger water flow than the ascending and descending motion at least once in the washing process P100.

In addition, the controller 70 may control the driver 50 such that, in the power motion M3, the rotator 100 continuously performs a strong rotation motion M4 in which the rotator 100 is rotated by a fifth amount of rotation R5 in each of said one direction C1 and the other direction C2, and a weak rotation motion M5 in which the rotator is rotated by a sixth amount of rotation R6 less than the fifth amount of rotation R5 in each of said one direction C1 and the other direction C2.

The washing motion of the present disclosure may further include the power motion M3 in addition to the ascending and descending motion. The power motion M3 may be understood as a washing motion intended to form the stronger water flow than the ascending and descending motion.

The power motion M3 may improve the effect of removing the foreign substances from the laundry in the cleaning process (P10) by forming the stronger water flow than the ascending and descending motion, and may be advantageous to separate the foreign substances or the detergent remaining in the laundry from the laundry or discharge the foreign substances or the detergent from the tub 20 in the rinsing process (P20).

The controller 70 may perform the power motion M3 more than once in the washing process (P100). In FIG. 10, a section in which the power motion M3 is performed according to an embodiment of the present disclosure is indicated by a dotted line area.

However, the section in which the power motion M3 is performed may not be limited as shown in FIG. 10, and may be performed various number of times in various processes and sections as needed.

The rotator 100 may be rotated at least 4 times in one cycle of the power motion M3. The rotations may be divided based on a change in the rotation direction.

Referring to FIG. 9, in the power motion M3, the rotator 100 may perform both the strong rotation motion M4 and the weak rotation motion M5. The number of executions or the order of the strong rotation motion M4 and the weak rotation motion M5 may be variously set as needed.

In the strong rotation motion M4, the rotator 100 may be rotated by the fifth amount of rotation R5 in said one direction C1 and rotated by the fifth amount of rotation R5 in the other direction C2. The order of the rotation in said one direction C1 and the rotation in the other direction C2 may be determined as needed.

The fifth amount of rotation R5 may be the same as or different from the first amount of rotation R1 and the third amount of distribution rotation R3 of the ascending and descending motion. For example, the fifth amount of rotation R5 may be equal to or greater than the first amount of rotation R1 and the third amount of distribution rotation R3.

In the strong rotation motion M4, the rotator 100 may form a relatively strong water flow with respect to that in the weak rotation motion M5 while rotating by the fifth amount of rotation R5 in said one direction C1 and the other direction C2.

In the strong rotation motion M4, the rotator 100 is rotated by the same amount of rotation in said one direction C1 and the other direction C2, so that it is not intended to form one of the ascending water flow and the descending water flow, and both the ascending water flow and the descending water flow are strongly formed in addition to the rotations in said one direction C1 and the other direction C2, thereby improving the washing effect.

In the power motion M3, the rotator 100 may perform the weak rotation motion M5 along with the strong rotation motion M4. In the weak rotation motion M5, the rotator 100 may perform the rotation in said one direction C1 and the rotation in the other direction C2, and the rotator 100 may be rotated by the sixth amount of rotation R6 in said one direction C1, and rotated by the sixth amount of rotation R6 in the other direction C2. In the weak rotation motion M5, the order of the rotation in said one direction C1 and the rotation in the other direction C2 may be variously determined.

The sixth amount of rotation R6 may be the amount of rotation less than the fifth amount of rotation R5. For example, in the sixth amount of rotation R6, the rotation angle of the rotator 100 may correspond to 720 degrees, and in the fifth amount of rotation R5, the rotation angle of the rotator 100 may correspond to 360 degrees.

However, the rotation angle is only an example for convenience of description and does not limit the present disclosure. The rotation angle may be variously set as needed.

The sixth amount of rotation R6 may be set independently set of the second amount of rotation R2 and the fourth amount of rotation R4 of the ascending and descending motion. For example, the sixth amount of rotation R6 may be the same as or different from the second amount of rotation R2 and the fourth amount of rotation R4. For example, the sixth amount of rotation R6 may be equal to or less than the second amount of rotation R2 and the fourth amount of rotation R4.

In addition, the execution order and the numbers of executions of the strong rotation motion M4 and the weak rotation motion M5 in the power motion M3 may be varied. For example, in the power motion M3, the rotator 100 may perform the weak rotation motion M5 after the strong rotation motion M4 is performed.

In the power motion M3, the rotation in said one direction C1 and the rotation in the other direction C2 of the rotator 100 are strongly made to increase the washing effect of the laundry in the strong rotation motion M4, and the rotation in said one direction C1 and the rotation in the other direction C2 of the rotator 100 are weakly made to ameliorate the curling phenomenon of the laundry while improving the uniformity of distribution of the laundry and suppress damage to the laundry in the weak rotation motion M5.

The fifth amount of rotation R5 and the sixth amount of rotation R6 may be defined as a concept including a rotation time for a rotation angle. For example, the fifth amount of rotation R5 may mean a certain rotation angle made within a certain time, and the sixth amount of rotation R6 may mean a rotation angle smaller than the certain rotation angle made within the certain time.

In this case, an rpm of the rotator 100 based on the fifth amount of rotation R5 is higher than an rpm of the rotator 100 based on the sixth amount of rotation R6, so that the washing effect of the laundry may be increased. However, the time for the rotation may be set variously, and the rotation times of the fifth amount of rotation R5 and the sixth amount of rotation R6 may also be set to be different or the same. The first amount of rotation R1 to the fourth amount of rotation R4 may also be defined in the relationship of the rpm as described above.

In one example, in one embodiment of the present disclosure, the controller 70 may control the driver 50 such that the rotator 100 performs the weak rotation motion M5 after performing the strong rotation motion M4 in the power motion M3.

As described above, the rotator 100 may perform the strong rotation motion M4 in the power motion M3 to perform the washing motion with the increased washing effect, and then perform the weak rotation motion M5 to suppress the curling or the damage of the laundry.

In other words, in one embodiment of the present disclosure, the controller 70 may control the driver 50 such that, in the power motion M3, the rotator 100 is rotated by the fifth amount of rotation R5 in one direction of said one direction C1 and the other direction C2, then is rotated by the fifth amount of rotation R5 in the remaining direction, then is rotated by the sixth amount of rotation R6 in one direction of said one direction C1 and the other direction C2, and then, is rotated by the sixth amount of rotation R6 in the remaining direction.

For example, in the power motion M3, the rotator 100 may be rotated by the fifth amount of rotation R5 in said one direction C1 and then rotated by the fifth amount of rotation R5 in the other direction C2. Thereafter, the rotator 100 may be rotated by the sixth amount of rotation R6 in said one direction C1 and then rotated by the sixth amount of rotation R6 in the other direction C2.

In one example, as described above, one embodiment of the present disclosure may further include the detergent feeder 25 constructed to supply the detergent to be provided to the tub 20 and the water supply 60 constructed to provide the water to be supplied to the tub 20.

The washing process (P100) may include the cleaning process (P10) in which the detergent is put into the tub 20 from the detergent feeder 25 and the foreign substances on the clothes are removed, and the rinsing process (P20) in which the water is supplied from the water supply 60 to the tub 20 and the foreign substances are discharged from the tub 20.

The controller 70 may control the driver 50 such that the rotator 100 performs the power motion M3 at least once in the cleaning process (P10) or the rinsing process (P20).

The power motion M3 may increase the washing or rinsing effect by forming the three-dimensional and strong water flow through the strong rotation of the rotator 100, and may improve the washing efficiency by performing a weak rotation of the rotator 100 to suppress the curling phenomenon or the damage of the laundry.

Therefore, the controller 70 may control the rotator 100 or the driver 50 such that the power motion M3 is performed at least once in the cleaning process (P10) or the rinsing process (P20), thereby improving the washing efficiency.

In FIG. 10, the section in which the power motion M3 is performed according to an embodiment of the present disclosure is indicated by the dotted line area. However, the dotted line area shown in FIG. 10 is an example for convenience of description and the present disclosure is not necessarily limited thereto. The power motion M3 may be performed various number of times in various sections as needed.

As described above, the ascending motion M1 may effectively induce the mixing between the laundry and the water or the detergent through the formation of the three-dimensional water flow after the water supply process (P40). After performing the ascending motion M1, the controller 70 may control the driver 50 such that the rotator 100 performs the power motion M3, so that the washing effect may be improved by forming the strong and three-dimensional water flow in the state in which the laundry and the water or the detergent are sufficiently mixed with each other.

In one example, in one embodiment of the present disclosure, when the amount of water supplied from the water supply 60 to the tub 20 is equal to or greater than the reference water supply amount, the controller 70 may control the driver 50 such that the rotator 100 replaces the power motion M3, which is performed when the water supply amount is less than the reference water supply amount, with the descending motion M2 at least once and performs the descending motion M2.

As described above, the descending motion M2 may improve an efficiency when the amount of water inside the tub 20 is equal to or greater than the reference water supply amount. Therefore, in one embodiment of the present disclosure, the power motion M3 may be performed when the amount of water inside the tub 20 is equal to or less than the reference water supply amount, and the descending motion M2 may be performed by replacing at least one cycle of the power motion M3 when the amount of water inside the tub 20 is equal to or greater than the reference water supply amount.

However, even when the amount of water inside the tub 20 is equal to or greater than the reference water supply amount, all of the power motions M3 do not necessarily have to be replaced with the descending motions M2, and the power motions M3 and the descending motions M2 may be performed in combination as needed. In FIG. 10, sections in which the power motion M3 and/or the descending motion M2 may be performed according to an embodiment of the present disclosure is shown as dotted line areas.

In one example, as described above, in one embodiment of the present disclosure, the drum 30 may be constructed to be rotatable inside the tub 20, and the driver 50 may be constructed to provide the rotational force to each of the rotator 100 and the drum 30.

Figure 11:
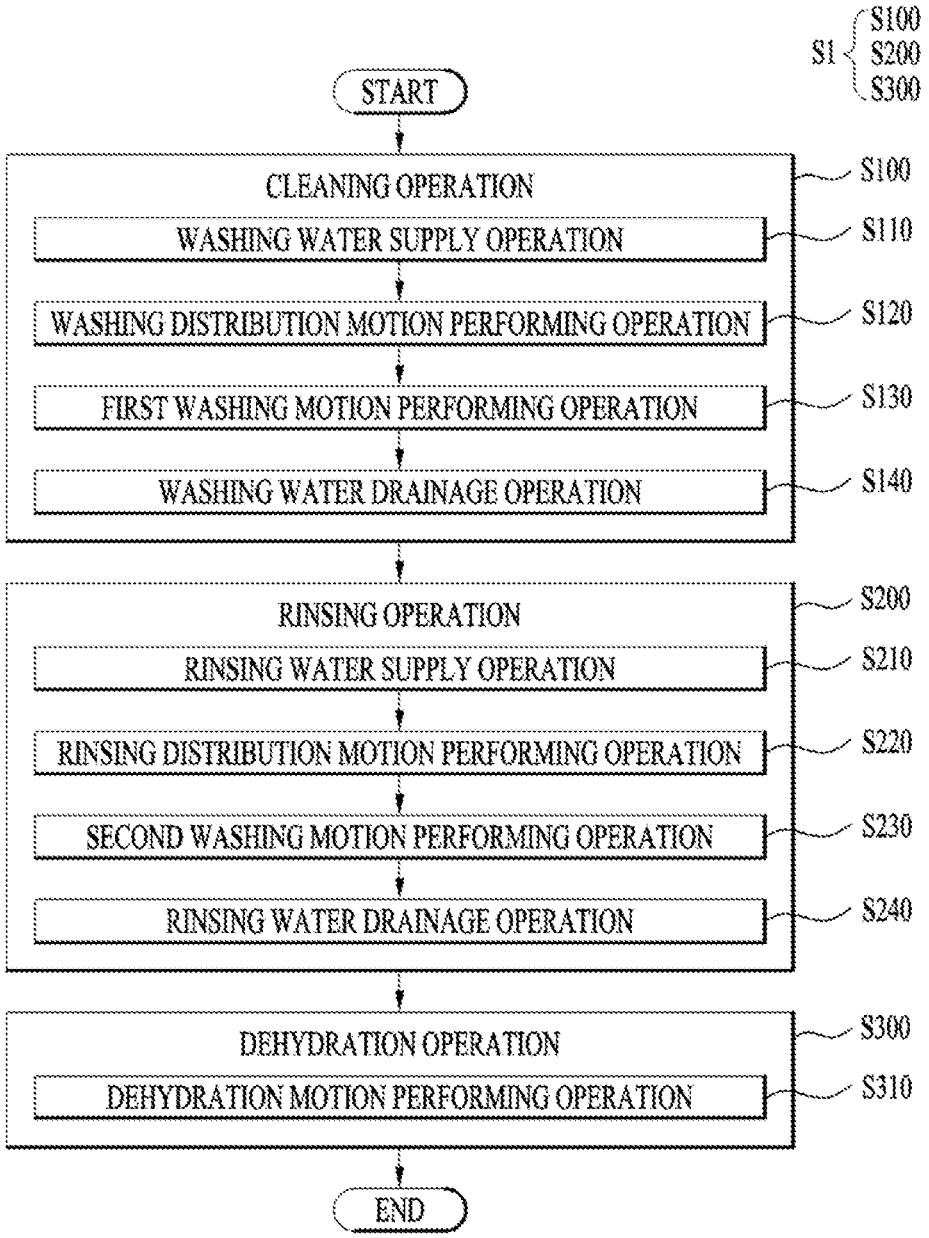
FIG. 11 is a flowchart illustrating a method for controlling a laundry treating apparatus according to an embodiment of the present disclosure.

FIG. 11 is a flowchart illustrating a method for controlling a laundry treating apparatus according to an embodiment of the present disclosure. However, an order of operations in the flowchart shown in FIG. 11 is only shown as an example for convenience of description. Repetition or an order change of the operations may be made variously as needed.

As described above, in one embodiment of the present disclosure, the laundry treating apparatus 1 may include the tub 20 in which the water is stored, the water supply 60 constructed to provide the water to the tub 20, the drum 30 disposed inside the tub 20 and into which the clothes are put, the rotator 100 rotatably installed on the bottom surface 33 of the drum 30, the driver 50 that provides the rotational force to the rotator 100, and the controller 70 that controls the driver 50.

The rotator 100 may include the bottom portion 110 disposed on the bottom surface 33 of the drum 30, and the pillar 150 that protrudes upward from the bottom portion 110 and having the blade 170 disposed on the outer circumferential surface thereof. The blade 170 may extend obliquely with respect to the longitudinal direction L of the pillar 150 to form the ascending water flow when the rotator 100 rotates in said one direction C1 and form the descending water flow when the rotator 100 rotates in the other direction C2.

In one example, referring to FIG. 11, a method for controlling the laundry treating apparatus 1 according to an embodiment of the present disclosure may include a washing operation (S1). The washing operation (S1) may include a cleaning operation (S100), a rinsing operation (S200), and a dehydration operation (S300).

The cleaning operation (S100) may remove the foreign substances from the clothes put into the drum 30. The rinsing operation (S200) may discharge the foreign material from the tub 20 after the cleaning operation (S100). The dehydration operation (S300) may remove the moisture from the clothes after the rinsing operation (S200).

The cleaning operation (S100) may include a washing water supply operation (S110), a washing distribution motion performing operation (S120), a first washing motion performing operation (S130), and a washing water drainage operation (S140).

That is, the washing operation (S1) may include a water supply operation in which the water is supplied into the tub 20 through the water supply 60 performed at least once. In addition, the controller 70 may control the driver 50 such that the rotator 100 performs the distribution motion N for defining the space between the clothes and the blade 170 after termination of the water supply operation. In addition, the controller 70 may control the driver 50 such that the rotator 100 performs the washing motion for forming the water flow after the distribution motion N. Furthermore, the controller 70 may control the driver 50 such that the amount of rotation of the rotator 100 in the distribution motion N is smaller than the amount of rotation of the rotator 100 in the washing motion.

Accordingly, when the washing motion is performed after the distribution motion N, the tangling phenomenon of the clothes with the blade 170 and the pillar 150 may be prevented as much as possible. In addition, when the washing motion is performed, it may be easy to form the three-dimensional water flow by the blade 170. Furthermore, the moment of inertia acting during the washing motion may be reduced in the rotator 100, and the driving load for rotating the rotator 100 may be reduced in the driver 50. In addition, the driver 50 may be easily controlled as the driving load is reduced when the washing motion is performed. In particular, the laundry treating apparatus 1 may be prevented as much as possible from the operation failure in the initial operation of the washing process (P100). Furthermore, the laundry treating apparatus 1 may increase the washing efficiency.

As described above, the laundry treating apparatus 1 may further include the water level sensor disposed in the tub 20 to measure the water level of the tub 20. In addition, the controller 70 may control the driver 50 to perform the distribution motion N only when the water level of the tub 20 is equal to or higher than the distribution reference water level H2.

That is, in the rotator 100, when the large amount of laundry is input during the washing motion, the tangling phenomenon of the laundry with the blade 170 and the pillar 150 by the rotation of the rotator 100 may be increased than when the small amount of laundry is input. That is, it may be preferable for the rotator 100 to perform the distribution motion N before the washing motion when the large amount of laundry is input. In other words, in the rotator 100, when the large amount of laundry is input, the reduction effect of the moment of inertia of the rotator 100 and the reduction rate of the driving load of the driver 50 may increased when the washing motion by the distribution motion N is performed than when the small amount of laundry is input.

In addition, when the small amount of laundry is input, in the rotator 100, the tangling phenomenon of the laundry with the blade 170 and the pillar 150 may less occur in the washing motion. Accordingly, the moment of inertia applied to the rotator 100 and the influence on the driving load of the driver 50 resulted from the tangling phenomenon may be negligible.

Figure 12:
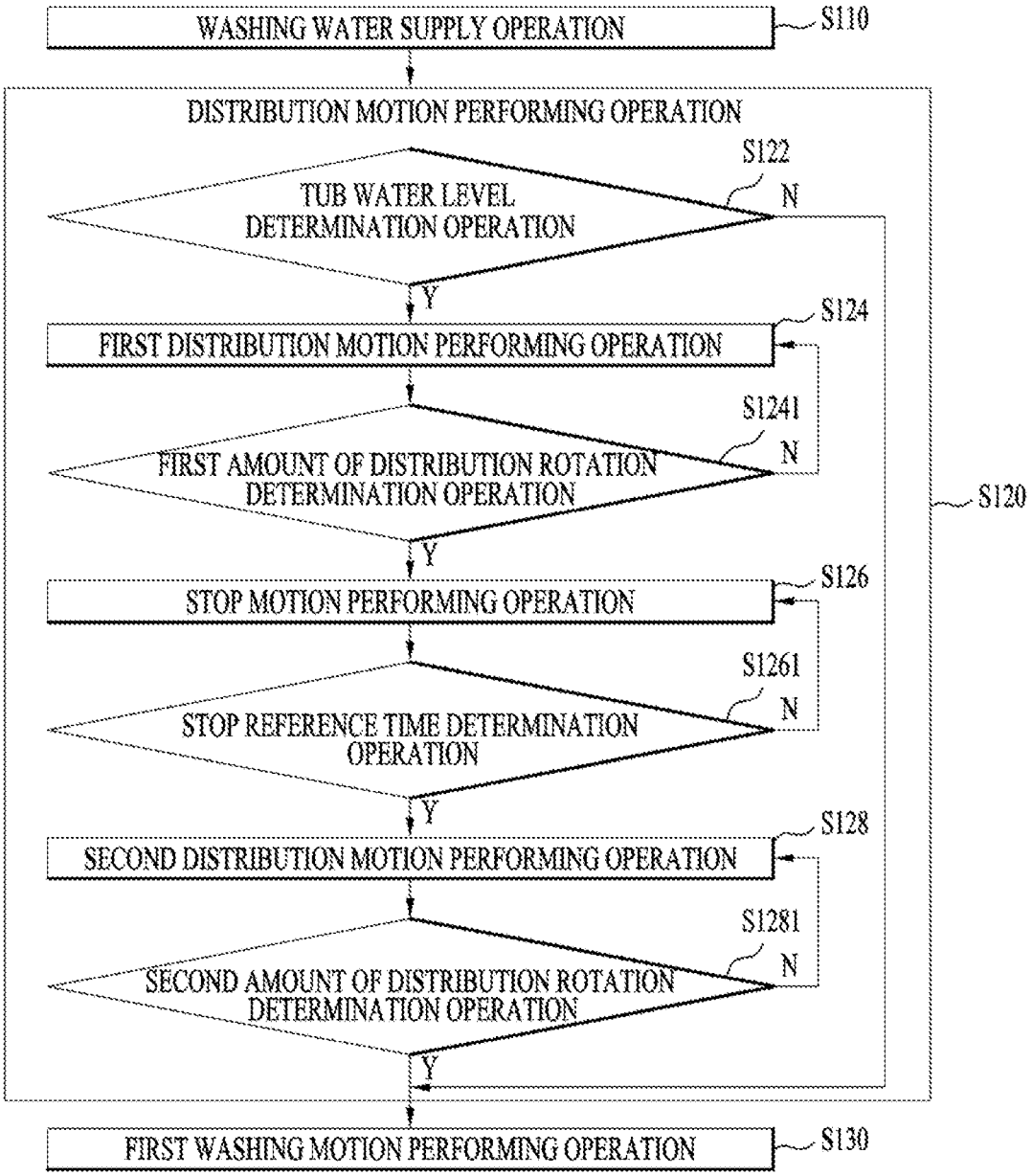
FIG. 12 is a flowchart illustrating a distribution motion performing operation in a method for controlling a laundry treating apparatus according to an embodiment of the present disclosure.

FIG. 12 is a flowchart illustrating a distribution motion performing operation in a method for controlling a laundry treating apparatus according to an embodiment of the present disclosure.

Referring to FIG. 12, in the method for controlling the laundry treating apparatus 1 according to an embodiment of the present disclosure, the washing distribution motion performing operation (S120) may include a tub water level determination operation (S122). In the tub water level determination operation (S122), the controller 70 may determine the water level of the tub 20 through the water level sensor. That is, the controller 70 may determine the amount of clothes put into the laundry treating apparatus 1 through the water level of the tub 20.

The controller 70 may determine whether the water level of the tub 20 in the washing distribution motion performing operation (S120) is equal to or higher than the distribution reference water level H2. When the water level of the tub 20 is equal to or higher than the distribution reference water level H2, a first distribution motion performing operation (S124) may be performed. When the water level of the tub 20 is equal to or lower than the distribution reference water level H2, the first washing motion performing operation (S130) may be performed.

In the first distribution motion performing operation (S124), the first distribution motion N1 of the rotator 100 may be performed. In the first washing motion performing operation (S130), the washing motion of the rotator 100 may be performed.

When the first distribution motion performing operation (S124) is performed, the controller 70 determines whether the rotator 100 rotates by an amount equal to or greater than the first amount of distribution rotation U1 in a first amount of distribution rotation determination operation (S1241). When the amount of rotation of the rotator 100 is equal to or greater than the first amount of distribution rotation U1, a stop motion performing operation (S126) may be performed. When the amount of rotation of the rotator 100 is less than the first amount of distribution rotation U1, the first distribution motion performing operation (S124) may be performed.

In the first distribution motion performing operation (S124), the first distribution motion N1 of the rotator 100 may be performed. In the stop motion performing operation (S126), the stop motion NS of the rotator 100 may be performed.

When the stop motion NS performing operation (S126) is performed, the controller 70 determines whether the rotator 100 is stopped for the stop reference time ts or longer in a stop reference time determination operation (S1261). When the rotator 100 is stopped for the stop reference time ts or longer, a second distribution motion performing operation (S128) may be performed. When the rotator 100 is stopped less than the stop reference time ts, the stop motion performing operation (S126) may be performed.

In the stop motion performing operation (S126), the stop motion NS of the rotator 100 may be performed. In the second distribution motion performing operation (S128), the second distribution motion N2 of the rotator 100 may be performed.

When the second distribution motion performing operation (S128) is performed, the controller 70 determines whether the rotator 100 rotates by an amount equal to or greater than the second amount of distribution rotation U2 in a second amount of distribution rotation determination operation (S1281). When the amount of rotation of the rotator 100 is equal to or greater than the second amount of distribution rotation U2, the first washing motion performing operation (S130) may be performed. When the amount of rotation of the rotator 100 is less than the second amount of distribution rotation U2, the second distribution motion performing operation (S128) may be performed.

In the second distribution motion performing operation (S128), the second distribution motion N2 of the rotator 100 may be performed. In the first washing motion performing operation (S130), the washing motion of the rotator 100 may be performed.

Figure 13:
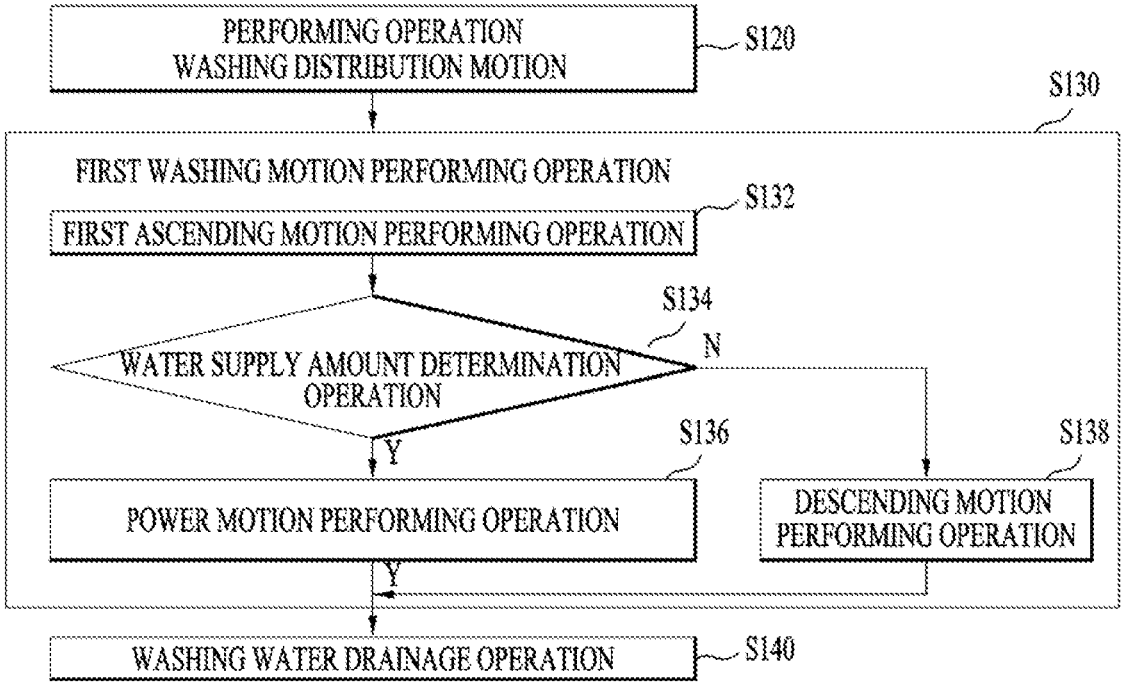
FIG. 13 is a flowchart illustrating a washing motion performing operation in a method for controlling a laundry treating apparatus according to an embodiment of the present disclosure.

FIG. 13 is a flowchart illustrating a washing motion performing operation in a method for controlling a laundry treating apparatus according to an embodiment of the present disclosure. Specifically, FIG. 13 is a flowchart showing the first washing motion performing operation (S130) performed in the cleaning operation (S100).

The first washing motion performing operation (S130) may be performed after the washing distribution motion performing operation (S120). The first washing motion performing operation (S130) may include a first ascending motion performing operation (S132). In the first ascending motion performing operation (S132), the ascending motion M1 of the rotator 100 is performed, so that the efficient mixing between the detergent, the water, and the laundry may be performed.

In addition, the first washing motion performing operation (S130) may include a water supply amount determination operation (S134). The water supply amount determination operation (S134) may be performed after the first ascending motion performing operation (S132). In the water supply amount determination operation (S134), the controller 70 or the water supply 60 may determine the amount of water supplied into the tub 20 through the water supply time, the water supply amount for each unit time, and the like. In addition, the controller 70 may determine the amount of water supplied through the water level sensor.

The controller 70 determines whether the water supply amount is less than the reference water supply amount in the water supply amount determination operation (S134). When the water supply amount is less than the reference water supply amount, the power motion performing operation (S136) may be performed. When the water supply amount is equal to or greater than the reference water supply amount, a descending motion performing operation (S138) may be performed.

In the power motion performing operation (S136), the power motion M3 of the rotator 100 may be performed. In the descending motion performing operation (S138), the descending motion M2 of the rotator 100 may be performed. However, the power motion performing operation (S136) and the descending motion performing operation (S138) do not necessarily include one of the power motion M3 and the descending motion M2, and may further include the ascending motion M1 and the like.

In one example, the rinsing operation (S200) may include a rinsing water supply operation (S210), a rinsing distribution motion performing operation (S220), a second washing motion performing operation (S230), and a rinsing water drainage operation (S240).

In the rinsing water supply operation (S210), the water may be supplied into the tub 20 by the water supply 60. In the rinsing distribution motion performing operation (S220), the first distribution motion N1 and the second distribution motion N2 may be performed. In addition, the rinsing distribution motion performing operation (S220) may be performed in the same manner as the washing distribution motion performing operation (S120). In the second washing motion performing operation (S220), the ascending motion M1, the power motion M3, the descending motion M2, and the like of the rotator 100 may be performed. In the rinsing drain operation (S240), the water inside the tub 20 may be discharged to the outside. The rinsing distribution motion performing operation (S220) may be performed in the same manner as the washing distribution motion performing operation (S120). In addition, the dehydration operation (S300) may include a dehydration motion performing operation (S310).

Although the present disclosure has shown and described with respect to a particular embodiment, it will be apparent to those of ordinary skill in the art that the present disclosure may be variously improved and changed without departing from the technical spirit of the present disclosure provided by the following claims.

What is claimed is:

1. A method for controlling a laundry treating apparatus including a tub configured to receive water, a water supply configured to supply water to the tub, a drum that is disposed inside the tub and has an open top surface configured to receive clothes therethrough, a rotator rotatably disposed at a bottom surface the drum, a driver configured to supply a rotational force to the rotator, and a controller configured to control the driver, the rotator including a bottom portion disposed at the bottom surface of the drum, a pillar that protrudes from the bottom portion toward the open top surface of the drum, and a blade disposed at an outer circumferential surface of the pillar, the method comprising:

performing a washing operation, the washing operation comprising:

a water supply process for supplying water into the tub through the water supply, and at least one of a cleaning operation for removing foreign substances from the clothes, a rinsing operation for discharging the foreign substances from the tub after the cleaning operation, or a dehydration operation for removing moisture from the clothes after the rinsing operation;

controlling, by the controller through the driver, the rotator to perform a distribution motion for separating the clothes from the blade after termination of the water supply process; and controlling, by the controller through the driver, the rotator to perform a washing motion for generating a water flow after the distribution motion, wherein a rotation amount of the rotator in the distribution motion is less than a rotation amount of the rotator in the washing motion.

2. The method of claim 1, wherein the laundry treating apparatus further includes a water level sensor configured to measure a water level in the tub, and wherein controlling the rotator to perform the distribution motion comprises:

performing the distribution motion based on the water level in the tub being greater than or equal to a distribution reference water level.

3. The method of claim 1, wherein the rotation amount of the rotator comprises at least one of a rotation speed of the rotator, a rotation angle of the rotator with respect to a reference position, or a number of revolutions of the rotator.

4. The method of claim 1, wherein controlling the rotator to perform the distribution motion comprises controlling the driver to rotate the rotator at a first rotation speed in the distribution motion, wherein controlling the rotator to perform the washing motion comprises controlling the driver to rotate the rotator at a second rotation speed of the rotator in the washing motion, and wherein the first rotation speed in the distribution motion is less than the second rotation speed of the rotator in the washing motion.

5. The method of claim 1, wherein controlling the rotator to perform the distribution motion comprises:

performing a first distribution motion by rotating the rotator in a first direction by a first amount of distribution rotation of the rotator; and performing a second distribution motion by rotating the rotator in a second direction opposite to the first direction by a second amount of distribution rotation of the rotator, the second amount of distribution rotation being equal to the first amount of distribution rotation.

6. The method of claim 5, wherein controlling the rotator to perform the distribution motion further comprises:

performing a stop motion for stopping rotation of the rotator after performing the first distribution motion; and performing the second distribution motion after performing the stop motion.

7. The method of claim 5, wherein controlling the rotator to perform the washing motion comprises:

rotating the rotator in the first direction by a first amount of washing rotation of the rotator to thereby generate an ascending water flow toward the open top surface of the drum; and rotating the rotator in the second direction by a second amount of washing rotation of the rotator to thereby generate a descending water flow toward the bottom surface of the drum, the second amount of washing rotation being different from the first amount of washing rotation.

* * * * *